US010755727B1

(12) United States Patent
Chu

(10) Patent No.: US 10,755,727 B1
(45) Date of Patent: Aug. 25, 2020

(54) DIRECTIONAL SPEECH SEPARATION

(71) Applicant: Amazon Technologies, Inc., Seattle, WA (US)

(72) Inventor: Wai Chung Chu, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 158 days.

(21) Appl. No.: 16/141,375

(22) Filed: Sep. 25, 2018

(51) Int. Cl.

| | |
|---|---|
| ***G10L 21/028*** | (2013.01) |
| ***H04R 1/40*** | (2006.01) |
| ***G10L 25/78*** | (2013.01) |
| *G10L 21/0216* | (2013.01) |

(52) U.S. Cl.
CPC ..... *G10L 21/028* (2013.01); *G10L 25/78* (2013.01); *H04R 1/406* (2013.01); *G10L 2021/02166* (2013.01); *H04R 2430/20* (2013.01)

(58) Field of Classification Search
CPC . G10L 2021/02166; G10L 2021/02082; G10L 2021/02165; G10L 21/0224; G10L 19/025; G10L 19/26; G10L 19/0212; G10L 2021/02087; G10L 21/0316; G10L 21/0388; G10L 19/06; G10L 21/0208; G10L 21/0216; G10L 25/78; G10L 15/20; G10L 21/0272; G10L 15/22; G10L 21/0232; G10L 17/22; G10L 2015/223; G10L 17/005; G10L 19/00; G10L 15/02; G10L 15/26; G10L 21/0264; G10L 19/008; G10L 25/84; G10L 2025/783
See application file for complete search history.

(56) References Cited

U.S. PATENT DOCUMENTS

2011/0131044 A1* 6/2011 Fukuda ..... G10L 15/20 704/246
2014/0369509 A1* 12/2014 Fukamachi ..... G01S 3/8083 381/56

* cited by examiner

*Primary Examiner* — Huyen X Vo
(74) *Attorney, Agent, or Firm* — Pierce Atwood LLP

(57) ABSTRACT

A system configured to perform directional speech separation. The system may dynamically associate direction-of-arrivals with one or more audio sources in order to generate output audio data that separates each of the audio sources. The system identifies a target direction for each audio source, dynamically determines directions that are correlated with the target direction, and generates output signals for each audio source. The system may associate individual frequency bands with specific directions based on a time delay detected by two or more microphones. The system may determine a cross-correlation between each direction and the target direction and select directions with strong correlation. The system may generate time-frequency mask data indicating frequency bands corresponding to the directions associated with a particular audio source. Using the mask data, the system generates output audio data specific to the audio source, resulting in directional speech separation between different audio sources.

20 Claims, 20 Drawing Sheets

DIRECTIONAL SPEECH SEPARATION

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

DETAILED DESCRIPTION

Figure 1:
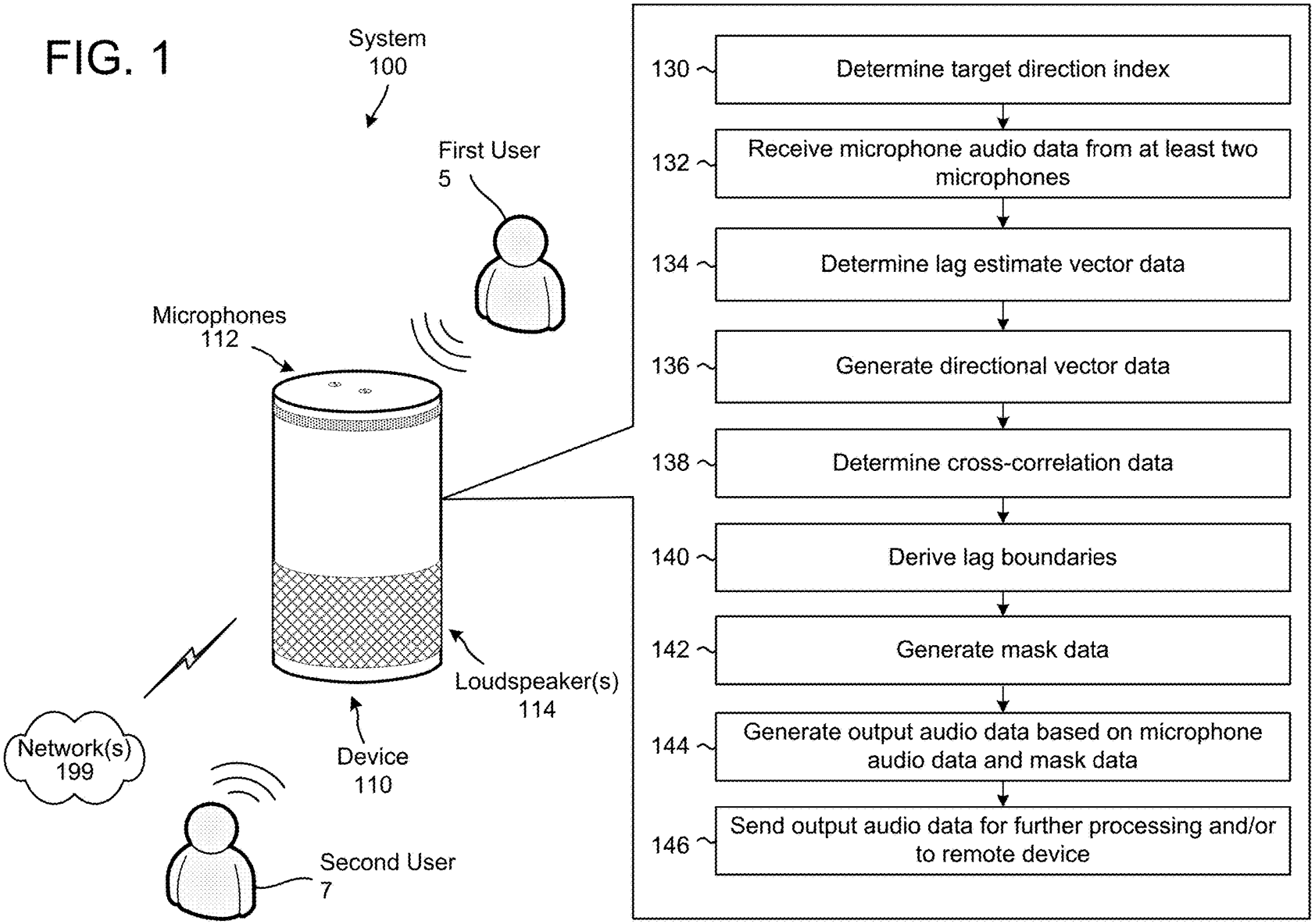
FIG. 1 illustrates a system according to embodiments of the present disclosure.

Electronic devices may be used to capture audio and process audio data. The audio data may be used for voice commands and/or sent to a remote device as part of a communication session. To process voice commands from a particular user or to send audio data that only corresponds to the particular user, the device may attempt to isolate desired speech associated with the user from undesired speech associated with other users and/or other sources of noise, such as audio generated by loudspeaker(s) or ambient noise in an environment around the device.

To isolate the desired speech, some techniques perform acoustic echo cancellation to remove, from the audio data, an "echo" signal corresponding to the audio generated by the loudspeaker(s), thus isolating the desired speech to be used for voice commands and/or the communication session from whatever other audio may exist in the environment of the user. Other techniques solve this problem by estimating the noise (e.g., undesired speech, echo signal from the loudspeaker, and/or ambient noise) based on the audio data captured by a microphone array. For example, these techniques may include fixed beamformers that beamform the audio data (e.g., separate the audio data into portions that corresponds to individual directions) and then perform acoustic echo cancellation using a target signal associated with one direction and a reference signal associated with a different direction (or all remaining directions). However, beamforming corresponds to linear filtering, which combines (linearly, through multiplication and addition) signals from different microphones. Thus, beamforming separates the audio data into uniform portions, which may not correspond to locations of audio sources.

To improve directional speech separation, devices, systems and methods are disclosed that dynamically determine directions of interest associated with individual audio sources. For example, the system can identify a target direction associated with an audio source and dynamically determine other directions of interest that are correlated with audio data from the target direction. The system may associate individual frequency bands with specific directions of interest based on a time delay (e.g., lag) between input audio data generated by two microphones. After separating the input audio data into different directions of interest, the system may generate energy data corresponding to an amount of energy associated with a direction for a sequence of time. The system may determine a cross-correlation between energy data associated with each direction and energy data associated with the target direction and may select directions that are correlated above a threshold. The system may generate time-frequency mask data that indicates individual frequency bands that correspond to the directions of interest associated with a particular audio source. Using this mask data, the device can generate output audio data that is specific to the audio source, resulting in directional speech separation between different audio sources.

FIG. 1 illustrates a high-level conceptual block diagram of a system 100 configured to perform directional speech separation. Although FIG. 1, and other figures/discussion illustrate the operation of the system in a particular order, the steps described may be performed in a different order (as well as certain steps removed or added) without departing from the intent of the disclosure. As illustrated in FIG. 1, the system 100 may include a device 110 that may be communicatively coupled to network(s) 199 and that may include microphone(s) 112 and loudspeaker(s) 114. Using the microphone(s) 112, the device 110 may capture audio data that includes a representation of first speech from a first user 5, a representation of second speech from a second user 7, a representation of audible sound output by loudspeaker(s)

114 and/or wireless loudspeaker(s) (not shown), and/or a representation of ambient noise in an environment around the device 110.

The device 110 may be an electronic device configured to capture, process and send audio data to remote devices. For ease of illustration, some audio data may be referred to as a signal, such as a playback signal x(t), an echo signal y(t), an echo estimate signal y'(t), a microphone signal z(t), an error signal m(t), or the like. However, the signals may be comprised of audio data and may be referred to as audio data (e.g., playback audio data x(t), echo audio data y(t), echo estimate audio data y'(t), microphone audio data z(t), error audio data m(t), etc.) without departing from the disclosure. As used herein, audio data (e.g., playback audio data, microphone audio data, or the like) may correspond to a specific range of frequency bands. For example, the playback audio data and/or the microphone audio data may correspond to a human hearing range (e.g., 20 Hz-20 kHz), although the disclosure is not limited thereto.

The device 110 may include one or more microphone(s) 112 and/or one or more loudspeaker(s) 114, although the disclosure is not limited thereto and the device 110 may include additional components without departing from the disclosure. The microphone(s) 112 may be included in a microphone array without departing from the disclosure. For ease of explanation, however, individual microphones included in a microphone array will be referred to as microphone(s) 112.

The techniques described herein are configured to perform directional source separation to separate audio data generated at a distance from the device 110. In some examples, the device 110 may send audio data to the loudspeaker(s) 114 and/or to wireless loudspeaker(s) (not shown) for playback. When the loudspeaker(s) 114 generate playback audio based on the audio data, the device 110 may perform additional audio processing prior to and/or subsequent to performing directional source separation. For example, the device 110 may perform acoustic echo cancellation on input audio data captured by the microphone(s) 112 prior to performing directional source separation (e.g., to remove echo from audio generated by the loudspeaker(s) 114) without departing from the disclosure. Additionally or alternatively, the device 110 may perform acoustic noise cancellation, acoustic interference cancellation, residual echo suppression, and/or the like on the output audio data generated after performing directional source separation. However, the disclosure is not limited thereto and the device 110 may not send audio data to the loudspeaker(s) 114 without departing from the disclosure.

While FIG. 1 illustrates that the microphone(s) 112 may capture audible sound from the loudspeaker(s) 114, this is intended for illustrative purposes only and the techniques disclosed herein may be applied to any source of audible sound without departing from the disclosure. For example, the microphone(s) 112 may capture audible sound generated by a device that includes external loudspeaker(s) (not shown) (e.g., a television) or from other sources of noise (e.g., mechanical devices such as a washing machine, microwave, vacuum, etc.). Additionally or alternatively, while FIG. 1 only illustrates the loudspeaker(s) 114, the disclosure is not limited thereto and the microphone(s) 112 may capture audio data from multiple loudspeakers and/or multiple sources of noise without departing from the disclosure.

The first user 5 may control the device 110 using voice commands and/or may use the device 110 for a communication session with a remote device (not shown). In some examples, the device 110 may send microphone audio data to the remote device as part of a Voice over Internet Protocol (VoIP) communication session. For example, the device 110 may send the microphone audio data to the remote device either directly or via remote server(s) (not shown). However, the disclosure is not limited thereto and in some examples, the device 110 may send the microphone audio data to the remote server(s) in order for the remote server(s) to determine a voice command. For example, the microphone audio data may include a voice command to control the device 110 and the device 110 may send the microphone audio data to the remote server(s), the remote server(s) 120 may determine the voice command represented in the microphone audio data and perform an action corresponding to the voice command (e.g., execute a command, send an instruction to the device 110 and/or other devices to execute the command, etc.). In some examples, to determine the voice command the remote server(s) may perform Automatic Speech Recognition (ASR) processing, Natural Language Understanding (NLU) processing and/or command processing. The voice commands may control the device 110, audio devices (e.g., play music over loudspeakers, capture audio using microphones, or the like), multimedia devices (e.g., play videos using a display, such as a television, computer, tablet or the like), smart home devices (e.g., change temperature controls, turn on/off lights, lock/unlock doors, etc.) or the like without departing from the disclosure.

The device 110 may perform directional speech separation in order to isolate audio data associated with each audio source. For example, the device 110 may generate first output audio data corresponding to a first audio source (e.g., isolate first speech generated by the first user 5), may generate second output audio data corresponding to a second audio source (e.g., isolate second speech generated by the second user 7), and/or generate third output audio data corresponding to a third audio source (e.g., isolate audible sounds associated with a wireless loudspeaker or other localized sources of sound). By separating the audio data according to each audio source, the device 110 may suppress undesired speech, echo signals, noise signals, and/or the like.

To illustrate an example, the device 110 may send playback audio data x(t) to wireless loudspeaker(s) and the loudspeaker(s) may generate playback audio (e.g., audible sound) based on the playback audio data x(t). A portion of the playback audio captured by the microphone(s) 112 may be referred to as an "echo," and therefore a representation of at least the portion of the playback audio may be referred to as echo audio data y(t). Using the microphone(s) 112, the device 110 may capture input audio as microphone audio data z(t), which may include a representation of the first speech from the first user 5 (e.g., first speech $s_1(t)$, which may be referred to as target speech), a representation of the second speech from the second user 7 (e.g., second speech $s_2(t)$, which may be referred to as distractor speech or non-target speech), a representation of the ambient noise in the environment around the device 110 (e.g., noise n(t)), and a representation of at least the portion of the playback audio (e.g., echo audio data y(t)). Thus, the microphone audio data may correspond to $z(t)=s_1(t))+s_2(t))+y(t)+n(t)$.

Conventional techniques perform acoustic echo cancellation to remove the echo audio data y(t) from the microphone audio data z(t) and isolate the first speech $s_1(t)$ (e.g., target speech). However, as the device cannot determine the echo audio data y(t) itself, the device instead generates echo estimate audio data y'(t) that corresponds to the echo audio data y(t). Thus, when the device removes the echo estimate signal y'(t) from the microphone signal z(t), the device is removing at least a portion of the echo signal y(t). The device 110 may remove the echo estimate audio data y'(t), the second speech $s_2(t)$, and/or the noise n(t) from the microphone audio data z(t) to generate an error signal m(t), which roughly corresponds to the first speech $s_1(t)$.

A typical Acoustic Echo Canceller (AEC) estimates the echo estimate audio data y'(t) based on the playback audio data x(t), and may not be configured to remove the second speech $s_2(t)$ (e.g., distractor speech) and/or the noise n(t). In addition, if the device does not send the playback audio data x(t) to the loudspeaker(s) 114 and/or the wireless loudspeaker(s), the typical AEC may not be configured to estimate or remove the echo estimate audio data y'(t).

To improve performance of the typical AEC, and to remove the echo when the loudspeaker(s) 114 is not controlled by the device, an AEC may be implemented using a fixed beamformer and may generate the echo estimate audio data y'(t) based on a portion of the microphone audio data z(t). For example, the fixed beamformer may separate the microphone audio data z(t) into distinct beamformed audio data associated with fixed directions (e.g., first beamformed audio data corresponding to a first direction, second beamformed audio data corresponding to a second direction, etc.), and the AEC may use a first portion (e.g., first beamformed audio data, which correspond to the first direction associated with the first user 5) as a target signal and a second portion (e.g., second beamformed audio data, third beamformed audio data, and/or remaining portions) as a reference signal. Thus, the AEC may generate the echo estimate audio data y'(t) from the reference signal and remove the echo estimate audio data y'(t) from the target signal. As this technique is capable of removing portions of the echo estimate audio data y'(t), the second speech $s_2(t)$, and/or the noise n(t), this may be referred to as an Acoustic Interference Canceller (AIC) instead of an AEC.

While the AIC implemented with beamforming is capable of removing acoustic interference associated with a distributed source (e.g., ambient environmental noise, reflections of the echo, etc., for which directionality is lost), performance suffers when attempting to remove acoustic interference associated with a localized source such as a wireless loudspeaker(s).

To improve output audio data, the device 110 illustrated in FIG. 1 may use two or more microphones 112 to perform speech signal separation. Based on a time delay between audio generated by an audio source being received by each of the microphones 112, the device 110 may determine an azimuth or direction-of-arrival (DOA) associated with the audio source. Using the azimuth or DOA information, the device 110 may distinguish between audio sources and generate output audio data associated with each of the audio sources. For example, the device 110 may generate first output audio data associated with a first audio source at a first azimuth and generate second output audio data associated with a second audio source at a second azimuth.

In contrast to linear filtering such as beamforming, the device 110 may dynamically determine which directions to associate with each audio source. For example, if the first audio source is well-separated from the second audio source, the device 110 may generate the first output audio data including first audio data associated with a first number of directions (e.g., direction-of-arrivals within 45 degrees of the audio source). However, if the second audio source is not well-separated from the second audio source, the device 110 may generate the first output audio data including second audio data associated with a second number of directions (e.g., direction-of-arrivals within 20 degrees of the audio source).

The device 110 may determine which directions to associate with an audio source based on a cross-correlation between energy values associated with each direction of interest over time and energy values associated with a target direction over time. Thus, the device 110 is selecting directions of interest by determining whether energy values of corresponding audio data is strongly correlated to energy values of audio data associated with the target direction (e.g., cross-correlation value exceeds a threshold value and/or satisfies a condition). In order to improve the output audio data generated for each audio source, the device 110 may determine a direction-of-arrival for individual frequency bands of the input audio data.

Figure 2A:
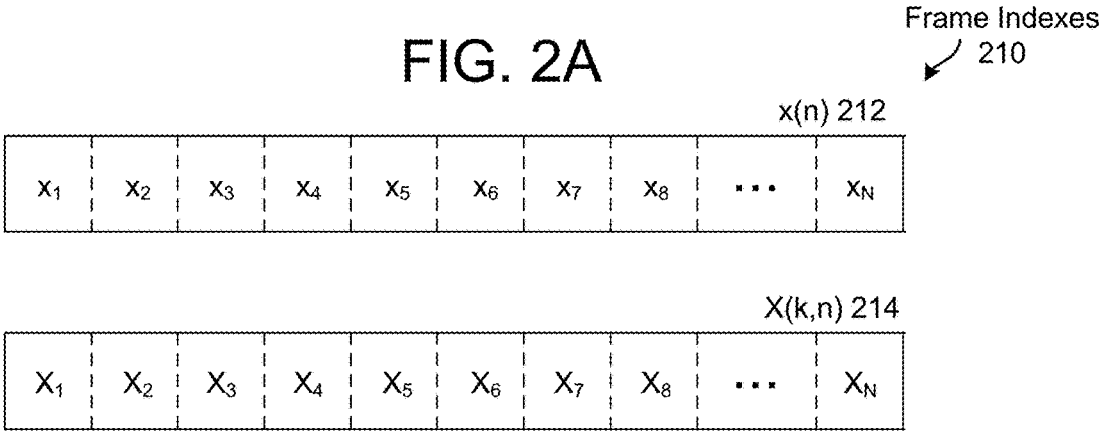
FIGS. 2A-2C illustrate examples of channel indexes, tone indexes and frame indexes.
Figure 2B:
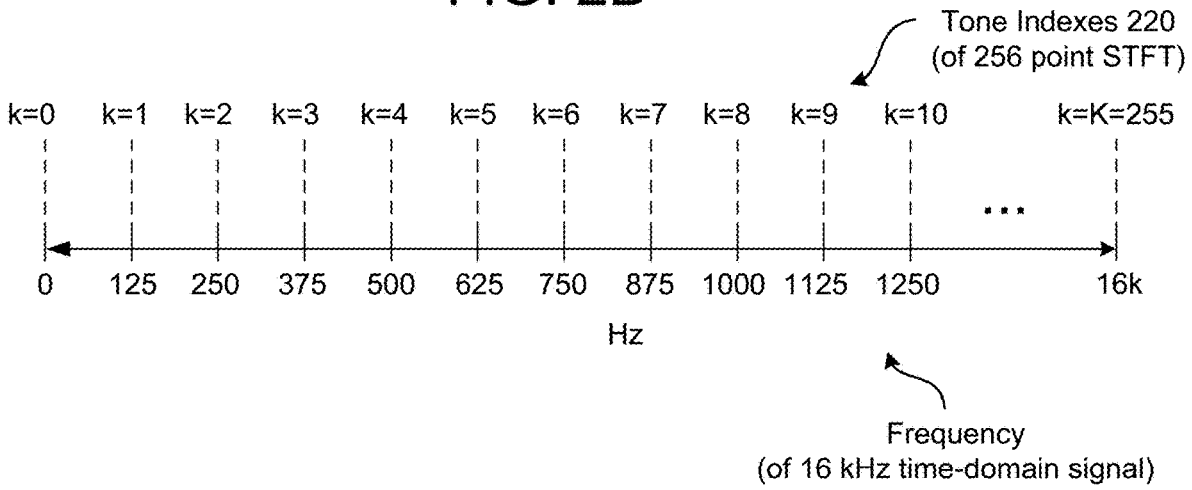
Figure 2C:
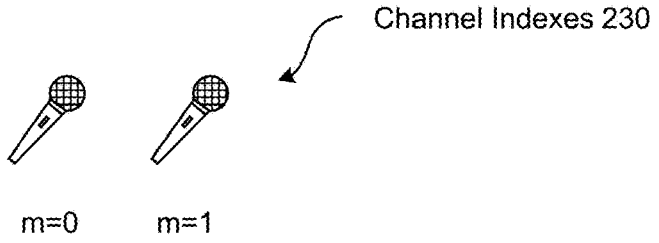

FIGS. 2A-2C illustrate examples of channel indexes, tone indexes and frame indexes. The device 110 may generate input audio data using microphone(s) 112. For example, the microphone(s) 112 may generate first input audio data in a time domain. For computational efficiency, however, the system 100 may convert the first input audio data to second input audio data in a frequency domain prior to processing the input audio data. Thus, the first input audio data (e.g., time-discrete signal) is transformed into the second input audio data in the frequency domain or subband domain. To convert from the time domain to the frequency or subband domain, the system 100 may use Discrete Fourier Transforms (DFTs), such as Fast Fourier transforms (FFTs), short-time Fourier Transforms (STFTs), and/or the like.

The following high level description of converting from the time domain to the frequency domain refers to microphone audio data x(n), which is a time-domain signal comprising output from the microphone(s) 112. As used herein, variable x(n) corresponds to the time-domain signal, whereas variable X(n) corresponds to a frequency-domain signal (e.g., after performing FFT on the microphone audio data x(n)). A Fast Fourier Transform (FFT) is a Fourier-related transform used to determine the sinusoidal frequency and phase content of a signal, and performing FFT produces a one-dimensional vector of complex numbers. This vector can be used to calculate a two-dimensional matrix of frequency magnitude versus frequency. In some examples, the system 100 may perform FFT on individual frames of audio data and generate a one-dimensional and/or a two-dimensional matrix corresponding to the microphone audio data X(n). However, the disclosure is not limited thereto and the system 100 may instead perform STFT without departing from the disclosure. A short-time Fourier transform (STFT) is a Fourier-related transform used to determine the sinusoidal frequency and phase content of local sections of a signal as it changes over time.

Using a Fourier transform, a sound wave such as music or human speech can be broken down into its component "tones" of different frequencies, each tone represented by a sine wave of a different amplitude and phase. Whereas a time-domain sound wave (e.g., a sinusoid) would ordinarily be represented by the amplitude of the wave over time, a frequency domain representation of that same waveform comprises a plurality of discrete amplitude values, where each amplitude value is for a different tone or "bin." So, for example, if the sound wave consisted solely of a pure sinusoidal 1 kHz tone, then the frequency domain representation would consist of a discrete amplitude spike in the bin containing 1 kHz, with the other bins at zero. In other words, each tone "k" is a frequency index (e.g., frequency bin).

FIG. 2A illustrates an example of frame indexes 210 including microphone audio data x(n) 212 in the time domain and microphone audio data X(k, n) 214 in the frequency domain. For example, the system 100 may apply a FFT to the time-domain microphone audio data x(n) 212, producing the frequency-domain microphone audio data X(k,n) 214, where the tone index "k" ranges from 0 to K and "n" is a frame index ranging from 0 to N. As illustrated in FIG. 2A, the history of the values across iterations is provided by the frame index "n", which ranges from 1 to N and represents a series of samples over time.

FIG. 2B illustrates an example of performing an K-point FFT on a time-domain signal. As illustrated in FIG. 2B, if a 256-point FFT is performed on a 16 kHz time-domain signal, the output is 256 complex numbers, where each complex number corresponds to a value at a frequency in increments of 16 kHz/256, such that there is 125 Hz between points, with point 0 corresponding to 0 Hz and point 255 corresponding to 16 kHz. As illustrated in FIG. 2B, each tone index 220 in the 256-point FFT corresponds to a frequency range (e.g., subband) in the 16 kHz time-domain signal. While FIG. 2B illustrates the frequency range being divided into 256 different subbands (e.g., tone indexes), the disclosure is not limited thereto and the system 100 may divide the frequency range into K different subbands. While FIG. 2B illustrates the tone index 220 being generated using a Fast Fourier Transform (FFT), the disclosure is not limited thereto. Instead, the tone index 220 may be generated using Short-Time Fourier Transform (STFT), generalized Discrete Fourier Transform (DFT) and/or other transforms known to one of skill in the art (e.g., discrete cosine transform, non-uniform filter bank, etc.).

Given a signal x(n), the FFT X(k,n) of x(n) is defined by $$X(k, n) = \sum_{j=0}^{K-1} x_j e^{-i2\pi * k * n * j/K} \quad [1]$$

Where k is a frequency index, n is a frame index, and K is an FFT size. Hence, for each block (at frame index n) of K samples, the FFT is performed which produces K complex tones X(k,n) corresponding to frequency index k and frame index n.

The system 100 may include multiple microphone(s) 112, with a first channel (m=0) corresponding to a first microphone 112*a*, a second channel (m=1) corresponding to a second microphone 112*b*, and so on until a final channel (M) that corresponds to microphone 112M. FIG. 2C illustrates channel indexes 230 including two microphones (e.g., two channels), Mic0 (m=0) and Mic1 (m=1). While many drawings illustrate two channels (e.g., two microphones 112), the disclosure is not limited thereto and the number of channels may vary. For example, the device 110 may include three or more microphones without departing from the disclosure. For the purposes of discussion, an example of system 100 includes "M" microphones 112 (M>1) for hands free near-end/far-end distant speech recognition applications.

Using at least two microphones 112 (e.g., Mic0 and Midi), the device 110 may separate audio data based on a direction of arrival. For example, audio (e.g., an audible noise) generated by a single sound source may be received by the two microphones at different times, resulting in a time delay (e.g., lag), and the device 110 may determine the direction of arrival based on this time delay. Knowing the direction of arrival enables the device 110 to distinguish between multiple sources of audio. Thus, the device 110 may receive input audio data from the two microphones 112 and may generate first audio data associated with a first sound source (e.g., first direction) and second audio data associated with a second sound source.

Figure 3A:
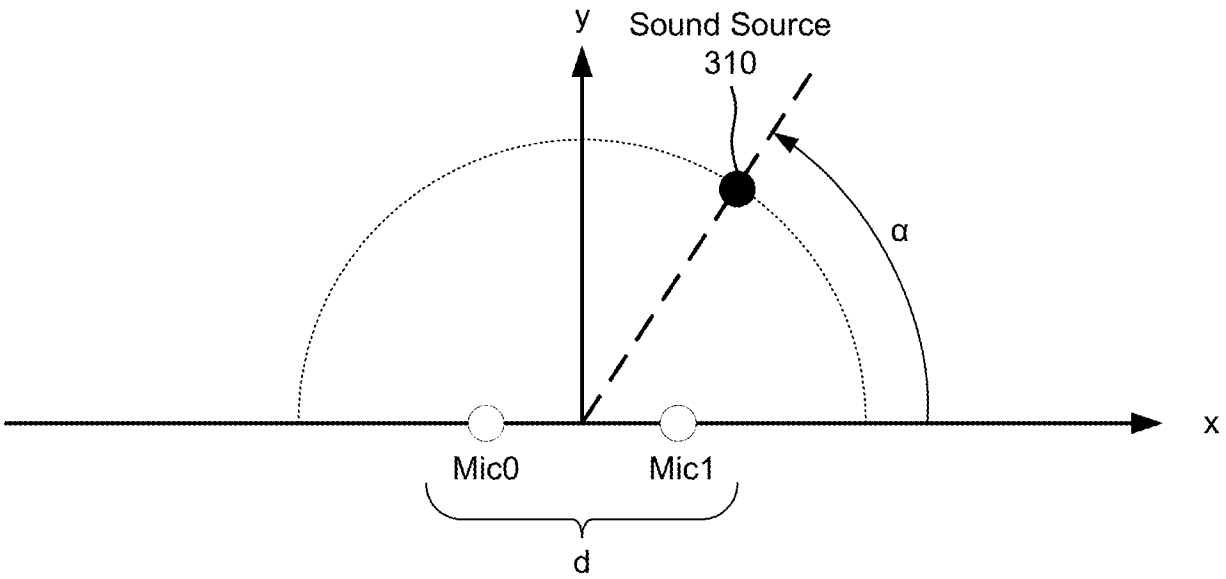
FIGS. 3A-3D illustrate examples of separating sound sources based on an angle of arrival according to examples of the present disclosure.

FIGS. 3A-3D illustrate examples of separating sound sources based on an angle of arrival according to examples of the present disclosure. As illustrated in FIG. 3A, the two microphones Mic0 and Mic1 may be separated by a known distance d. This distance may be selected to improve sound source separation and avoid spatial aliasing. As illustrated in FIG. 3A, the device 110 may identify a sound source 310 and may determine an azimuth α associated with the sound source 310. Based on the azimuth α, the device 110 may identify audio data associated with the sound source 310.

Figure 3B:
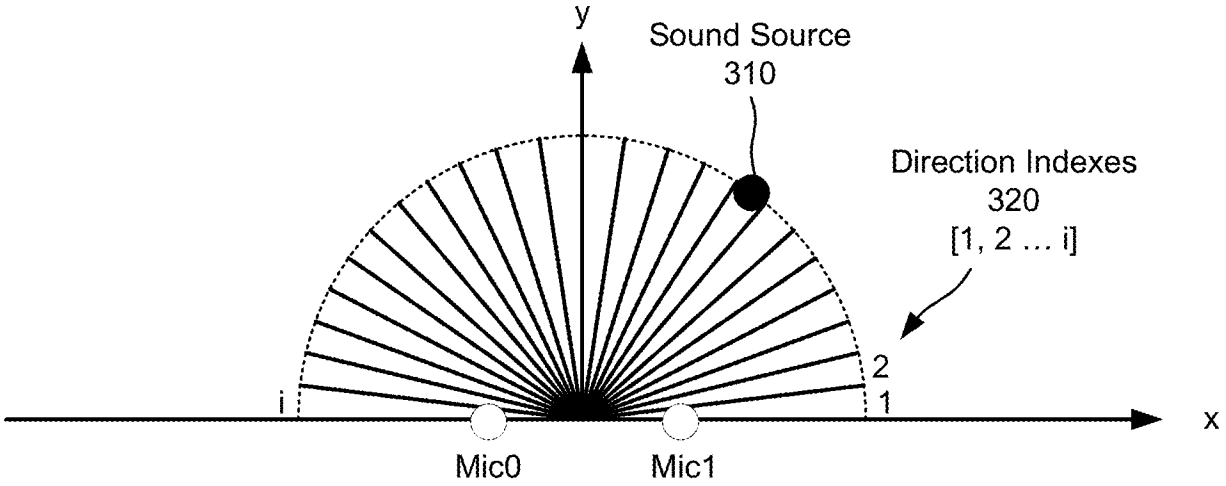

FIG. 3B illustrates that the device 110 may generate uniformly divided azimuth intervals, which may be referred to as direction indexes 320. FIG. 3B illustrates the device 110 generating i intervals, such that the direction indexes 320 range from 1 to i. For example, FIG. 3B illustrates 24 intervals, corresponding to 24 direction indexes, with the sound source 310 located in direction index 8. However, the disclosure is not limited thereto and the device 110 may generate any number of intervals without departing from the disclosure.

When the device 110 only uses two microphones (e.g., Mic0 and Mic1) to perform sound source separation, such as in the example shown in FIG. 3B, the device 110 can determine an angle of arrival along a single axis (e.g., x axis). Thus, the device 110 can generate azimuth intervals for 180 degrees, but not 360 degrees. For example, if a second sound source was located at the same position as the sound source 310 but flipped along the y axis (e.g., sound source 310 at coordinates [x,y], second sound source at coordinates [x, −y]), the device 110 would not be able to separate the two sound sources as the audio signals would have the same time delay. However, the disclosure is not limited thereto and if the device 110 includes three or more microphones 112 the device 110 may separate sound sources along the y-axis as well as the x-axis.

In some examples, the device 110 may use two microphones (e.g., Mic0 and Mic1, with Mic1 separated from Mic0 along the x-axis) to generate first uniformly divided azimuth intervals for 180 degrees along the x-axis, as illustrated in FIG. 3B, and also use two microphones (e.g., Mic1 and Mic2, with Mic2 separated from Mic1 along the y-axis) to generate second uniformly divided azimuth intervals for 180 degrees along the y-axis. Based on a combination of the first azimuth intervals and the second azimuth intervals, the device 110 may determine whether multiple sound sources have the same time delay and may separate the sound sources along both the x-axis and the y-axis. Additionally or alternatively, the device 110 may perform more complicated processing using the three or more microphones (e.g., Mic0, Mic1, and Mic2, with Mic1 separated from Mic0 along the x-axis and Mic2 separated from either Mic0 or Mic1 along the y-axis) to generate uniformly divided azimuth intervals for 360 degrees along both the x-axis and the y-axis without departing from the disclosure. For example, the device 110 may determine a first time delay between the first microphone (Mic0) and the second microphone (Mic1) and a second time delay between the second microphone (Mic1) and the third microphone (Mic2) and may determine an angle of arrival with 360 degree precision. For ease of illustration, the disclosure will describe the two-microphone solution. However, the techniques disclosed herein are applicable to the three or more microphone solution without departing from the disclosure.

While the example illustrated in FIG. 3B shows the sound source 310 being within direction index 8, the device 110 does not simply isolate first audio data that is associated with direction index 8. Instead, the device 110 may identify neighboring direction indexes that include second audio data that is also associated with the sound source 310 and may isolate combined audio data (first audio data and second audio data) from a range of direction indexes including direction index 8. For example, the device 110 may identify a target direction (e.g., direction index 8, target azimuth α, etc.), may determine first audio data that is associated with the target direction, and may dynamically determine which direction indexes include second audio data that is correlated with the first audio data.

Figure 3C:
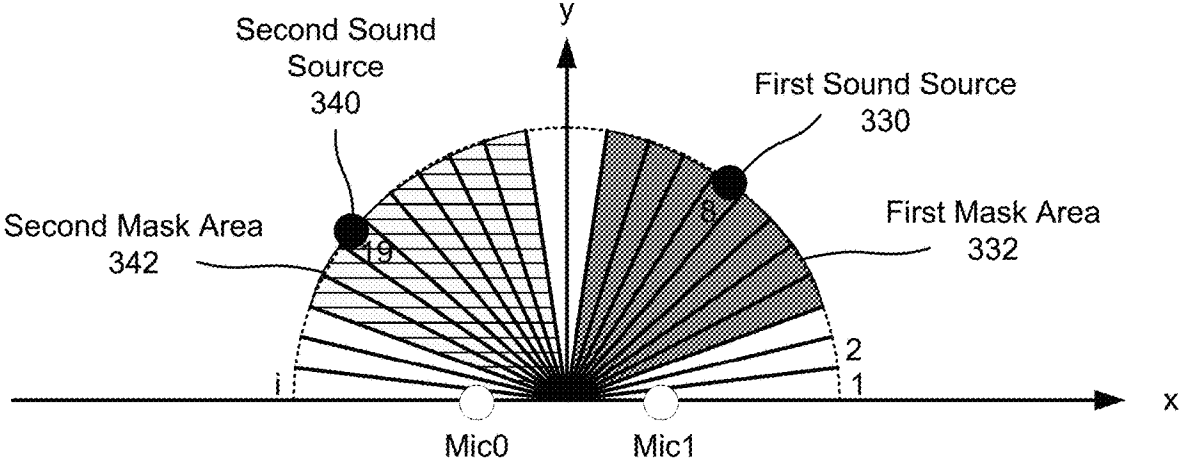

FIG. 3C illustrates an example in which there are two sound sources separated by a relatively large distance. As illustrated in FIG. 3C, a first sound source 330 is located at a first position (e.g., direction index 8) and a second sound source 340 is located at a second position (e.g., direction index 19). Due to the relatively large separation between the two sound sources, the device 110 may isolate first audio data within a first mask area 332 (e.g., from direction index 4 to direction index 11) and associate the first audio data with the first sound source 330, while also isolating second audio data within a second mask area 342 (e.g., from direction index 14 to direction index 21) and associating the second audio data with the second sound source 340.

Figure 3D:
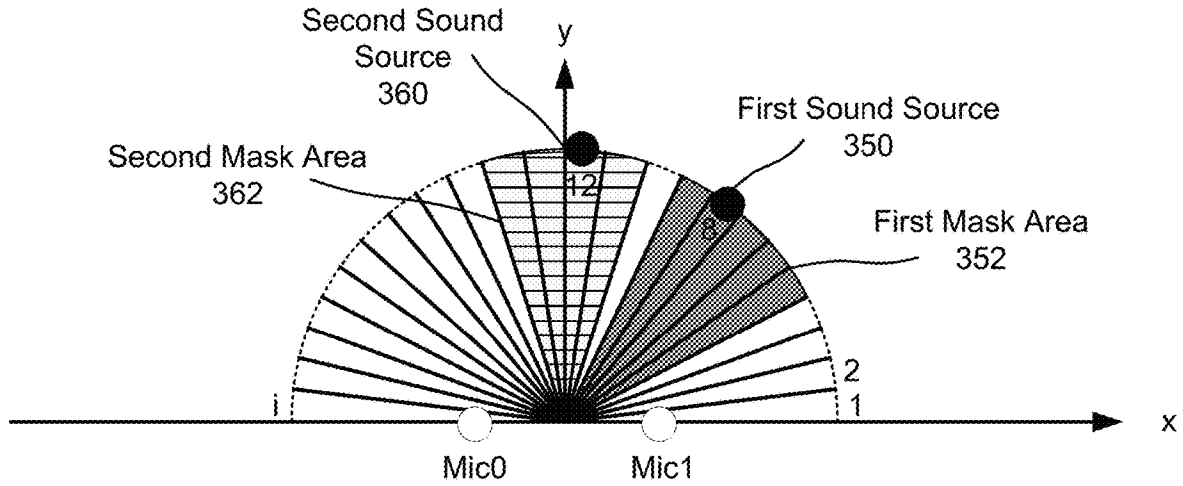

In contrast, FIG. 3D illustrates an example in which there are two sound sources separated by a relatively small distance. As illustrated in FIG. 3D, a first sound source 350 is located at a first position (e.g., direction index 8) and a second sound source 360 is located at a second position (e.g., direction index 12). Due to the relatively small separation between the two sound sources, the device 110 may isolate first audio data within a first mask area 352 (e.g., from direction index 5 to direction index 9) and associate the first audio data with the first sound source 350, while also isolating second audio data within a second mask area 362 (e.g., from direction index 11 to direction index 14) and associating the second audio data with the second sound source 360.

In some examples, the device 110 may determine the target direction regardless of a location of a sound source. For example, the device 110 may select each of the direction indexes 320 as a target direction and repeat the steps for each of the target directions. In other examples, the device 110 may determine the target direction based on a location of a sound source. For example, the device 110 may identify the sound source, determine a location of the sound source (e.g., the direction index associated with the sound source, a target azimuth α corresponding to the sound source, etc.), and select a target direction based on the location of the sound source. Additionally or alternatively, the device 110 may track a sound source over time. For example, the sound source may correspond to a user walking around the device, and the device 110 may select a first direction index as a target direction at a first time and select a second direction index as a target direction at a second time, based on movement of the user.

Figure 4:
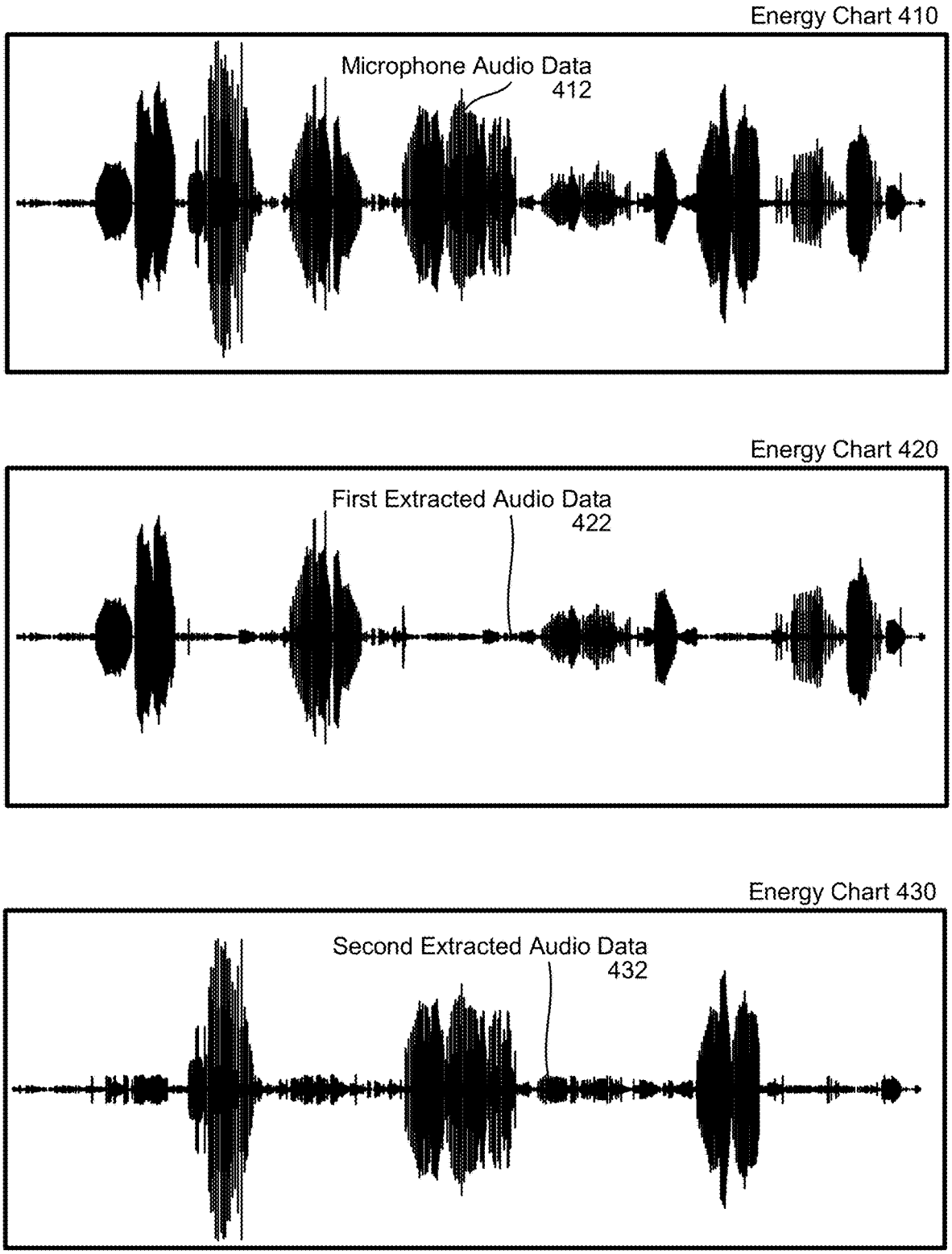
FIG. 4 illustrates an example of extracting audio data corresponding to different directions according to examples of the present disclosure.

FIG. 4 illustrates an example of extracting audio data corresponding to different directions according to examples of the present disclosure. As illustrated in FIG. 4, energy chart 410 includes a representation of microphone audio data 412. The microphone audio data 412 includes first speech from a first user and second speech from a second user. Based on a time delay between when the microphones 112 receive the first speech and the second speech, the device 110 may determine that the first speech corresponds to a first direction index and that the second speech corresponds to a second direction index. Based on this information, the device 110 may extract first extracted audio data 422, shown in energy chart 420, which includes audio data associated with the first speech and the first direction index. Similarly, the device 110 may extract second extracted audio data 432, shown in energy chart 430, which includes audio data associated with the second speech and the second direction index. Thus, the device 110 may separate audio data generated by different sound sources based on the direction of arrival, but may include additional audio data that is strongly correlated to the sound source.

As used herein, a sound source corresponds to a distinct source of audible sound, typically located at a distance from the device 110. Thus, a sound source may correspond to localized sources such as a user, a loudspeaker, mechanical noise, pets/animals, and/or the like, but does not correspond to diffuse sources such as ambient noise or background noise in the environment. In some examples, the device 110 may isolate first audio data associated with a desired sound source, such as desired speech generated by a first user. The device 110 may output the first audio data without performing additional audio processing, but the disclosure is not limited thereto. Instead, the device 110 may perform additional audio processing such as acoustic echo cancellation, acoustic interference cancellation, residual echo suppression, and/or the like to further remove echo signals, undesired speech, and/or other noise signals. For example, the device 110 may isolate second audio data associated with undesired sound source(s), such as undesired speech, playback audio generated by a loudspeaker, distracting noises in the environment, etc. Using the first audio data as a target signal and the second audio data as a reference signal, the device 110 may perform acoustic interference cancellation to subtract or remove at least a portion of the second audio data from the first audio data.

As illustrated in FIG. 1, the device 110 may determine (130) a target direction index. In order to associate direction indexes with an audio source, the device 110 first needs to determine a target direction index associated with the audio source. The device 110 may determine the target direction index using multiple techniques, including receiving a target azimuth value and determining a target direction index corresponding to the target azimuth value, tracking a location of the audio source and determining a target direction index corresponding to the location, determining a target direction index based on peaks in magnitudes of energy values of the input audio data, and/or the like. Note that if the device 110 determines the target direction index based on peaks in magnitude of the energy values, this step may be performed after steps 134-136, as described in greater detail below with regard to FIGS. 5 and 7.

As discussed above, the device 110 may generate output audio data for multiple audio sources. Thus, the device 110 will need to perform the steps described below using multiple target direction indexes, with a unique target direction index corresponding to each audio source.

The device 110 may receive (132) microphone audio data from at least two microphones 112 and may determine (134) lag estimate vector data (e.g., lag estimate data) based on the microphone audio data. For example, the microphone audio data may include first audio data generated by a first microphone 112*a* and second audio data generated by a second microphone 112*b*. To determine the lag estimate vector data, the device 110 may convert the microphone audio data from the time domain to the frequency domain and determine a time delay (e.g., lag estimate value) between the first audio data and the second audio data for each frequency index k.

The lag estimate values correspond to a direction-of-arrival or azimuth associated with the audio source that generated the audio data. Thus, the device 110 may identify a direction index i that corresponds to the lag estimate value for an individual frequency index k, as will be discussed in greater detail below with regard to FIG. 5. For example, each direction index i corresponds to a range of time delays (e.g., lag values). Therefore, the device 110 may generate (136) directional vector data by identifying the direction index i corresponding to the lag estimate value for each frequency index k in the lag estimate vector data.

In some examples, the directional vector data may indicate the specific direction index associated with each of the frequency indexes k. For example, the directional vector data may include direction mask data that identifies the frequency indexes associated with a particular direction index i. Using the direction mask data, the device 110 may extract audio data for each direction index i and/or may determine an energy value associated with audio data corresponding to each direction index i. Additionally or alternatively, the directional vector data may include the energy values associated with each direction index i with or without the direction mask data.

The device 110 may determine (138) cross-correlation data based on the directional vector data. For example, the device 110 may perform a cross-correlation between each direction index i and a target direction index it to determine cross-correlation values, as will be described in greater detail below with regard to FIGS. 5 and 8. The directional vector data may include energy values for each frequency index over a period of time. For example, the directional vector data may include a current energy value for a specific frequency index, as well as energy values associated with the specific frequency index over m previous frames. As part of determining the cross-correlation data, the device 110 may smooth the energy values over time, may smooth the cross-correlation values over time, and/or may normalize the cross-correlation values so that the cross-correlation data comprises values between 0.0 and 1.0, with cross-correlation values closer to 1.0 indicating a strong correlation between the direction index i and the target direction index it.

Based on the cross-correlation data, the device 110 may derive (140) lag boundaries associated with the audio source. For example, the device 110 may determine a lower bound (e.g., direction index i below the target direction index it) and an upper bound (e.g., direction index I above the target direction index it) that indicates a range of direction indexes that are strongly correlated to the target direction index it. As will be described in greater detail below with regard to FIGS. 5 and 9, the device 110 may determine the lower bound and the upper bound based on a cross-correlation threshold value. For example, if the cross-correlation threshold value is equal to 0.8, the device 110 may identify the lower bound and the upper bound based on where the cross-correlation data intersects 0.8 (e.g., drops below 0.8).

The lag boundaries identify the direction indexes that correspond to the audio source. Thus, the lag boundaries may vary over time based on which direction indexes are strongly correlated with the target direction index it. To generate output audio data corresponding to the audio source, the device 110 may generate (142) mask data based on the lag boundaries. The mask data corresponds to a time-frequency map or vector that indicates the frequency indexes k that are associated with the audio source over time. For example, the device 110 may identify frequency indexes k that are associated with each of the direction indexes i included within the lag boundaries (e.g., between the lower boundary and the upper boundary).

In some examples, the mask data may correspond to binary masks, which may include binary flags for each of the time-frequency units. Thus, a first binary value (e.g., digital high or a value of 1) indicates that the time-frequency unit corresponds to the audio source and a second binary value (e.g., digital low or a value of 0) indicates that the time-frequency unit does not correspond to the audio source.

The device 110 may generate a binary mask for each audio source. Thus, a first binary mask may classify each time-frequency unit as either being associated with a first audio source or not associated with the first audio source. Similarly, a second binary mask may classify each time-frequency unit as either being associated with a second audio source or not associated with the second audio source, and so on for each audio source detected by the device 110.

The device 110 may generate (144) output audio data based on the microphone audio data and the mask data and may send (146) the output audio data for further processing and/or to the remove device. For example, the device 110 may generate combined audio data based on the first audio data and the second audio data, such as by averaging the first audio data and the second audio data. The device 110 may then apply the mask data to the combined audio data to generate the output audio data. Thus, the output audio data corresponds to the frequency indexes k that are associated with the audio source. As discussed above, the device 110 may generate multiple output audio signals, with each output audio signal corresponding to a unique audio source. For example, the device 110 may determine that there are two or more audio sources based on the lag estimate vector data and/or the directional vector data and may perform steps 138-142 separately for each audio source.

Figure 5:
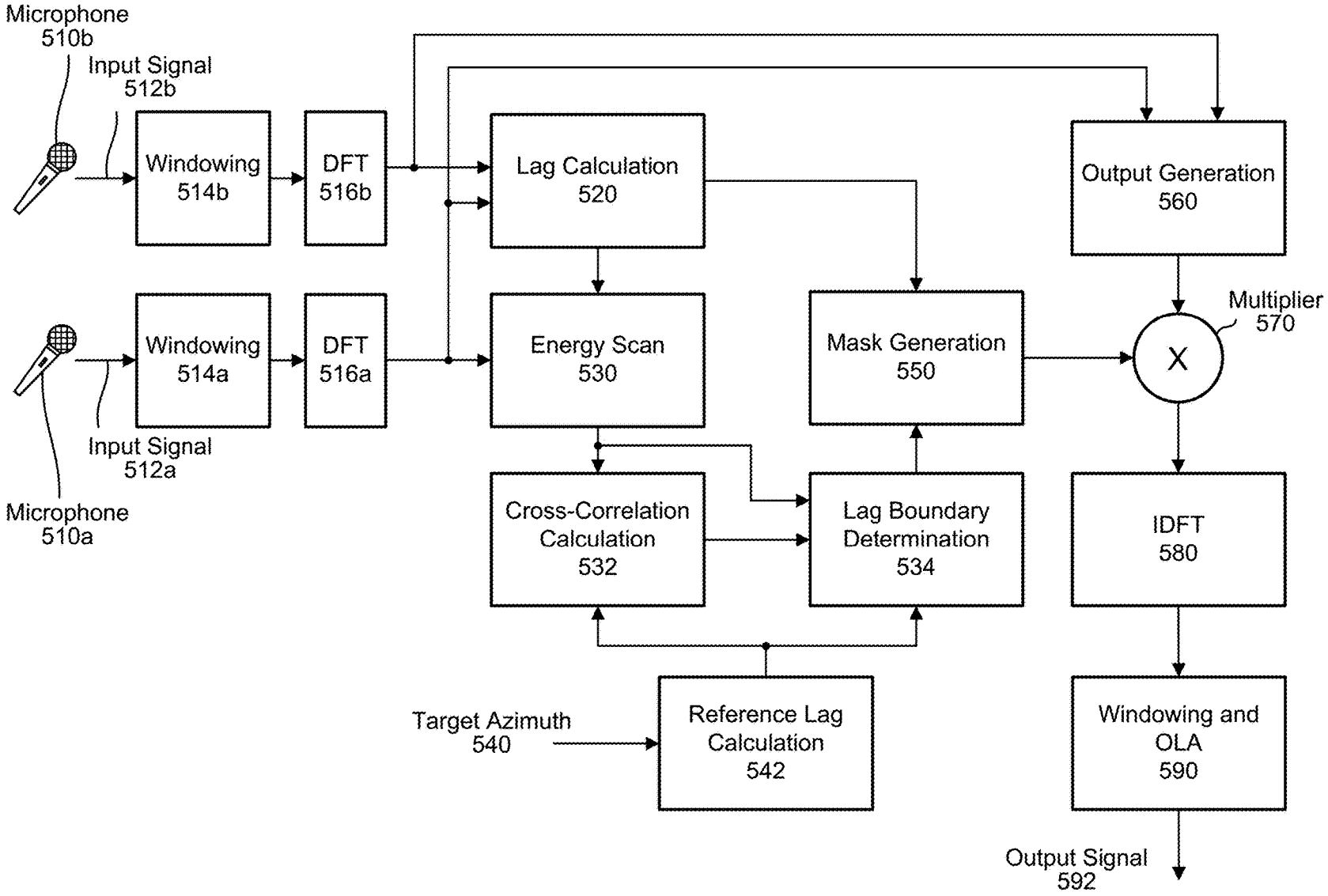
FIG. 5 illustrates an example component diagram for performing directional speech separation according to examples of the present disclosure.

FIG. 5 illustrates an example component diagram for performing directional speech separation according to examples of the present disclosure. As illustrated in FIG. 5, microphones 510 may capture audio as input signals 512 in a time domain and the device 110 may perform windowing 514 and Discrete Fourier Transforms (DFTs) to convert the input signals 512 to a frequency domain. For example, a first microphone 510*a* may generate a first input signal 512*a* and the device 110 may perform first windowing 514*a* and a first DFT 516*a* to convert the first input signal 512*a* to a first modified input signal in the frequency domain. Similarly, a second microphone 510*b* may generate a second input signal 512*b* and the device 110 may perform second windowing 514*b* and a second DFT 516*b* to convert the second input signal 512*b* to a second modified input signal in the frequency domain.

To illustrate an example, the input signals 512 at the present frame index may be denoted by:

$$x_0[n], x_1[n], n=0 \text{ to } N-1 \quad [2.1]$$

where $x_0[n]$ is the first input signal 512*a*, $x_1[n]$ is the second input signal 512*b*, *n* is a current frame index, and N is a length of the window (e.g., number of frames included). The input frames are mapped to the frequency domain via DFT:

$$x_0[n]w[n] \xleftrightarrow{DFT} X_0[k], k=0 \text{ to } N_f-1 \quad [2.2]$$

$$X_1[n]w[n] \xleftrightarrow{DFT} X_1[k], k=0 \text{ to } N_f-1 \quad [2.3]$$

where $x_0[n]$ is the first input signal 512*a*, $x_1[n]$ is the second input signal 512*b*, *n* is a current frame index, $X_0[k]$ is the first modified input signal, $X_1[k]$ is the second modified input signal, k is a frequency band from 0 to $N_f$, and $N_f$ corresponds to the number of DFT/FFT coefficients (e.g., $N_f=N_{FFT}/2+1$).

The first modified input signal and the second modified input signal are output to two components—lag calculation 520 and output generation 560. Lag calculation 520, which will be discussed in greater detail below, determines a time delay (e.g., lag) between the first modified input signal and the second modified input signal for individual frequency bands (e.g., frequency ranges, frequency bins, etc.) to generate estimated lag vector data. The output generation 560 generates an output signal based on a combination of the first modified input signal and the second modified input signal. For example, the output generation 560 may generate the output signal using an averaging function to determine a mean of the first modified input signal and the second modified input signal, although the disclosure is not limited thereto.

As mentioned above, the lag calculation 520 receives the first modified input signal and the second modified input signal and determines a lag estimate value for each frequency band k (e.g., tone index). Thus, the lag calculation 520 generates lag estimate vector data including k number of lag estimate values.

The lag calculation 520 may generate the estimated lag values based on phase information between the input signals 512. For example, the phase at frequency index k between the two channels is calculated with:

$$\text{phase}[k]=\arg(X_0[k]X_1^*[k]),k=0 \text{ to } N_f-1 \quad [3.1]$$

where k is a frequency band from 0 to $N_f-1$, phase[k] corresponds to a phase between the input signals 512 within the frequency band k, $X_0[k]$ is the first modified input signal, $X_1[k]$ is the second modified input signal, and $N_f$ corresponds to the number of DFT/FFT coefficients (e.g., $N_f=N_{FFT}/2+1$).

The lag values of the signals are found with:

$$\text{lag}[k] = \begin{cases} 0, & \text{if } k = 0 \\ \frac{N_{FFT}}{2\pi k}\,\text{phase}[k], & \text{otherwise} \end{cases}, \quad [3.2]$$

$$k = 0 \text{ to } N_f - 1$$

Using the equations described above, the device 110 may determine an estimated lag value for each frequency band k (e.g., lag[k]).

As mentioned above with regard to FIG. 3B, the estimated lag values correspond to direction indexes, such that the device 110 may associate a particular estimated lag value with a particular direction index (e.g., direction of arrival). In some examples, the device 110 may associate the estimated lag value with a corresponding direction index based on lag value ranges associated with the direction indexes. For example, a first direction index (e.g., between $\alpha_0$ and $\alpha_1$) may correspond to estimated lag values between $t_0$ and $t_1$, a second direction index (e.g., between $\alpha_1$ and $\alpha_2$) may correspond to estimated lag values between $t_1$ and $t_2$, and so on. Thus, the device 110 may store the lag value ranges for each of the direction indexes and use these lag value ranges to associate each frequency band with an individual direction of arrival. For example, after determining which direction index corresponds to the estimated lag value for a particular frequency band k, the device 110 may associate the frequency band k with the corresponding direction index.

Additionally or alternatively, the device 110 may associate the estimated lag values with a corresponding direction index based on a target azimuth (e.g., azimuth associated with a center point of the direction index) using a lag threshold. For example, instead of associating a range of lag values (e.g., between $t_0$ and $t_1$) with a first direction index that corresponds to a range between a lower azimuth $\alpha_0$ and an upper azimuth $\alpha_1$, the device 110 may associate a target azimuth $\alpha_a$ with the first direction index, may determine a target lag value $t_a$ corresponding to the target azimuth $\alpha_a$, and may determine whether the estimated lag value is within a lag threshold value of the target lag value $t_a$ (e.g., $t_a-\text{LAG_TH}\leq\text{Lag}[k]\leq t_a+\text{LAG_TH}$). Thus, the target lag value $t_a$ (corresponding to the target azimuth $\alpha_a$) and the lag threshold value may roughly correspond to the range of lag values described above.

To illustrate an example, given targetAzimuth$\in[0, \pi]$, which is a parameter passed to the algorithm with the intention to extract signal at that particular direction (e.g., azimuth $\alpha$ associated with a particular direction index), then:

$$targetLag = \cos(targetAzimuth)\frac{d \cdot f_s}{c}\langle\text{Sampling period}\rangle \quad [4.1]$$

where targetLag is the time lag of interest, targetAzimuth is the azimuth $\alpha$ associated with a direction of interest (e.g., individual direction index), d is the distance between the microphones 112 in meters (m) (e.g., distance d between Mic0 and Mic1, as illustrated in FIG. 3A), $f_s$ is the sampling frequency in Hertz (Hz), c is the speed of sound (e.g., c=342 m/s), and Sampling period is the duration of the sampling.

The wavelength is given by:

$$\lambda=c/f<m> \quad [4.2]$$

with frequency:

$$f=k\cdot f_s/N_{FFT}<Hz>,k=0 \text{ to } N_f-1 \quad [4.3]$$

and period:

$$T=N_{FFT}/(k\cdot f_s)<s>,k=0 \text{ to } N_f-1 \quad [4.4]$$

Using the estimated lag value (e.g., lag[k]) associated with an individual frequency band, the device 110 may determine an absolute difference between the estimated lag value and the target lag value for the frequency band. The device 110 may use the absolute difference and the lag threshold value to generate a mask associated with the frequency band:

$$\text{mask}[k] = \begin{cases} 1, & \text{if } |\text{lag}[k] - targetLag| < \text{LAG_TH} \\ 0, & \text{otherwise} \end{cases} \quad [5]$$

where mask[k] corresponds to a mask value associated with the frequency band k, lag[k] is a lag value for the frequency band k, targetLag is the target lag calculated based on the target azimuth $\alpha$ using Equation [3.2], and LAG_TH is a selected lag threshold. The lag threshold may be fixed or may vary without departing from the disclosure.

Spatial aliasing occurs when multiple valid lags exist within a range. However, spatial aliasing may be avoided by selecting the distance d between the microphones 112 appropriately. While not disclosed herein, one of skill in the art may modify Equation [5] to take into account spatial aliasing without departing from the disclosure. For example, instead of using a single target lag value (e.g., targetLag[k]), Equation [5] may be modified to include a two-dimensional array of target lags (e.g., targetLag[k, l], selecting the target lag closest to the lag value lag[k] (e.g., min|lag[k]−[targetLag[k, l]|).

To summarize, the lag calculation 520 may determine an estimated lag value for each frequency band using Equations [3.1]-[3.2] to generate the estimated lag vector data. After generating the estimated lag vector data, the device 110 may generate direction mask data for each direction index, with the direction mask data indicating whether a particular frequency band corresponds to the direction index. In some examples, the direction mask data may be a two-dimensional vector, with k number of frequency bands and i number of direction indexes (e.g., k-by-i matrix or i-by-k matrix).

In some examples, the lag calculation 520 may output the direction mask data to energy scan 530. However, the disclosure is not limited thereto and in other examples, the lag calculation 520 may output the estimated lag vector data and the energy scan 530 may generate the direction mask data without departing from the disclosure.

In some examples, the energy scan 530 may apply the direction mask data to the first modified input signal in order to extract audio data corresponding to each of the direction indexes. For example, as the direction mask data indicates which frequency band corresponds to a particular direction index, applying the direction mask data to the first modified input signal generates an audio signal for each of the direction indexes. The energy scan 530 may then determine an amount of energy associated with the audio signal for each direction index. For example, the energy scan 530 may determine a first energy value corresponding to an amount of energy associated with a first direction index, a second energy value corresponding to an amount of energy associated with a second direction index, and so on for each of the direction indexes. While the above example refers to determining an amount of energy associated with an individual direction index, the disclosure is not limited thereto and the energy scan 530 may use any technique known to one of skill in the art without departing from the disclosure. For example, the energy scan 530 may determine a square of the energy (e.g., energy squared), an absolute value, and/or the like without departing from the disclosure. Additionally or alternatively, the device 110 may smooth the magnitude over time without departing from the disclosure.

In other examples, the energy scan 530 may determine the amount of energy associated with each direction index without first extracting audio data corresponding to each of the direction indexes. For example, the energy scan 530 may apply the direction mask data to identify a first portion of the first modified input audio data, which is associated with the first direction index, and may determine a first energy value corresponding to an amount of energy associated with the first portion of the first modified input audio data. Similarly, the energy scan 530 may apply the direction mask data to identify a second portion of the first modified input audio data, which is associated with the second direction index, and may determine a second energy value corresponding to an amount of energy associated with the second portion of the first modified input audio data, and so on for each of the direction indexes.

Figure 6:
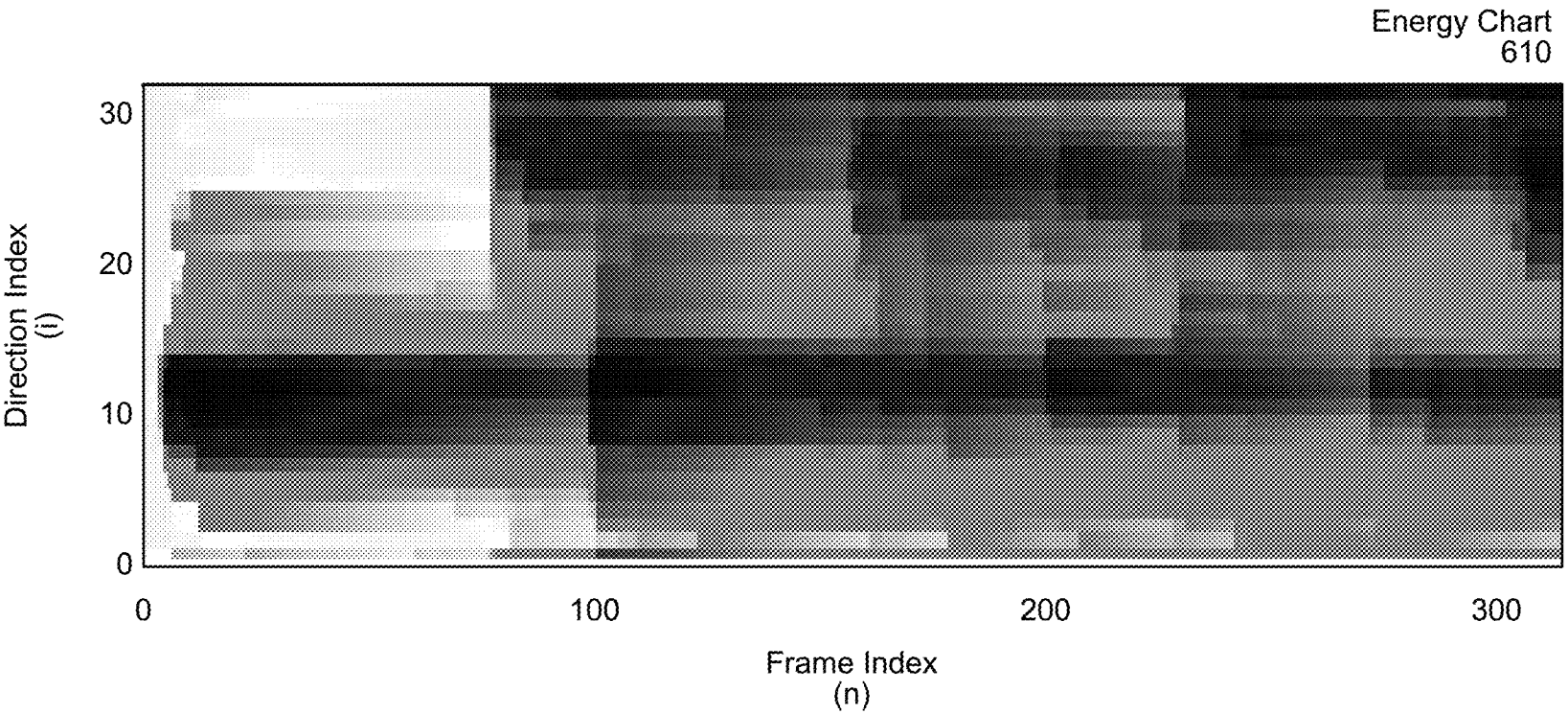
FIG. 6 illustrates an example of an energy chart representing energy associated with different direction indexes according to examples of the present disclosure.

FIG. 6 illustrates an example of an energy chart representing energy associated with different direction indexes according to examples of the present disclosure. As illustrated in FIG. 6, an energy chart 610 may represent time (e.g., via frame index n) along the horizontal axis (e.g., x-axis) and may represent a direction of arrival (e.g., via direction index i) along the vertical axis (e.g., y-axis), with a magnitude represented by a color between white (e.g., low magnitude) and black (e.g., high magnitude).

The energy chart 610 illustrated in FIG. 6 includes 32 unique direction indexes (e.g., i=1, 2, . . . 32), such that each direction index corresponds to a range of 5.6 degrees. Thus, the direction indexes correspond to incoming direction of arrivals (e.g., azimuths) from 0 degrees to 180 degrees, with direction index 1 including azimuths between 0 degrees and 5.6 degrees (e.g., center point of 2.8 degrees with a threshold value of +/−2.8 degrees), direction index 2 including azimuths between 5.6 degrees and 11.2 degrees (e.g., center point of 8.4 degrees with a threshold value of +/−2.8 degrees), and direction index 32 including azimuths between 174.4 degrees and 180 degrees (e.g., center point of 177.2 degrees with a threshold value of +/−2.8 degrees).

A horizontal row within the energy chart 610 corresponds to a single direction index i, with each frame index n corresponding to an energy value associated with the direction index i. Similarly, a vertical column within the energy chart 610 corresponds to a single frame index n, with each direction index i corresponding to an energy value associated with the frame index n. Thus, the energy chart 610 illustrates that the device 110 may determine magnitude values associated with one or more direction indexes i and/or one or more frame indexes n.

As illustrated in the energy chart 610 shown in FIG. 6, audio sources may be represented as bands of high magnitude values (e.g., regions of black) associated with a range of direction indexes, and unique audio sources may be separated by bands of low magnitude values (e.g., regions of white or gray). For example, the energy chart 610 includes a single audio source centered roughly on direction index 10 (e.g., direction indexes 8-14) at a first time (e.g., frame index 50), but at a second time (e.g., frame index 100) the energy chart 610 includes a first audio source centered roughly on direction index 10 (e.g., direction indexes 9-15) and a second audio source centered roughly on direction index 28 (e.g., direction indexes 25-32). As illustrated in FIG. 6, the specific direction indexes associated with an audio source may vary over time, with the first audio source corresponding to a first range (e.g., direction indexes 8-14) at the first time and a second range (e.g., direction indexes 9-15) at the second time.

Referring back to FIG. 5, the energy scan 530 may output directional vector data (e.g., vector including a magnitude of energy values corresponding to each direction index for a series of frame indexes) to cross-correlation calculation 532, which may perform a cross-correlation between each of the direction indexes and a target direction index. For example, if direction index 11 is selected as the target direction index, the cross-correlation calculation 532 may perform a first cross-correlation between direction index 1 and direction index 11, a second cross-correlation between direction index 2 and direction index 11, and so on for each of the 32 direction indexes. As mentioned above, the directional vector data may include a time sequence for each of the direction indexes, such as m frames of energy values for each direction index i.

In some examples, the device 110 may determine the target direction index by detecting one or more peaks within the energy curves (e.g., directional vector data). A single peak corresponds to a single audio source, and therefore the device 110 may select the target direction index based on this peak. For example, reference lag calculation 542 may receive a target azimuth 540 corresponding to the peak and may determine the target direction index that includes the target azimuth 540. Additionally or alternatively, reference lag calculation 542 may receive the target direction index associated with the peak instead of receiving the target azimuth 540.

If the device 110 detects multiple peaks in the directional vector data, this may correspond to two or more audio sources. In this case, the device 110 may select multiple target direction indexes and generate output audio data associated with each of the target direction indexes (e.g., individual output audio data for each audio source). In some examples, the device 110 may remove shallow (e.g., broad) peaks in the energy chart in order to generate output audio data associated with only the strongest audio sources.

Figure 7:
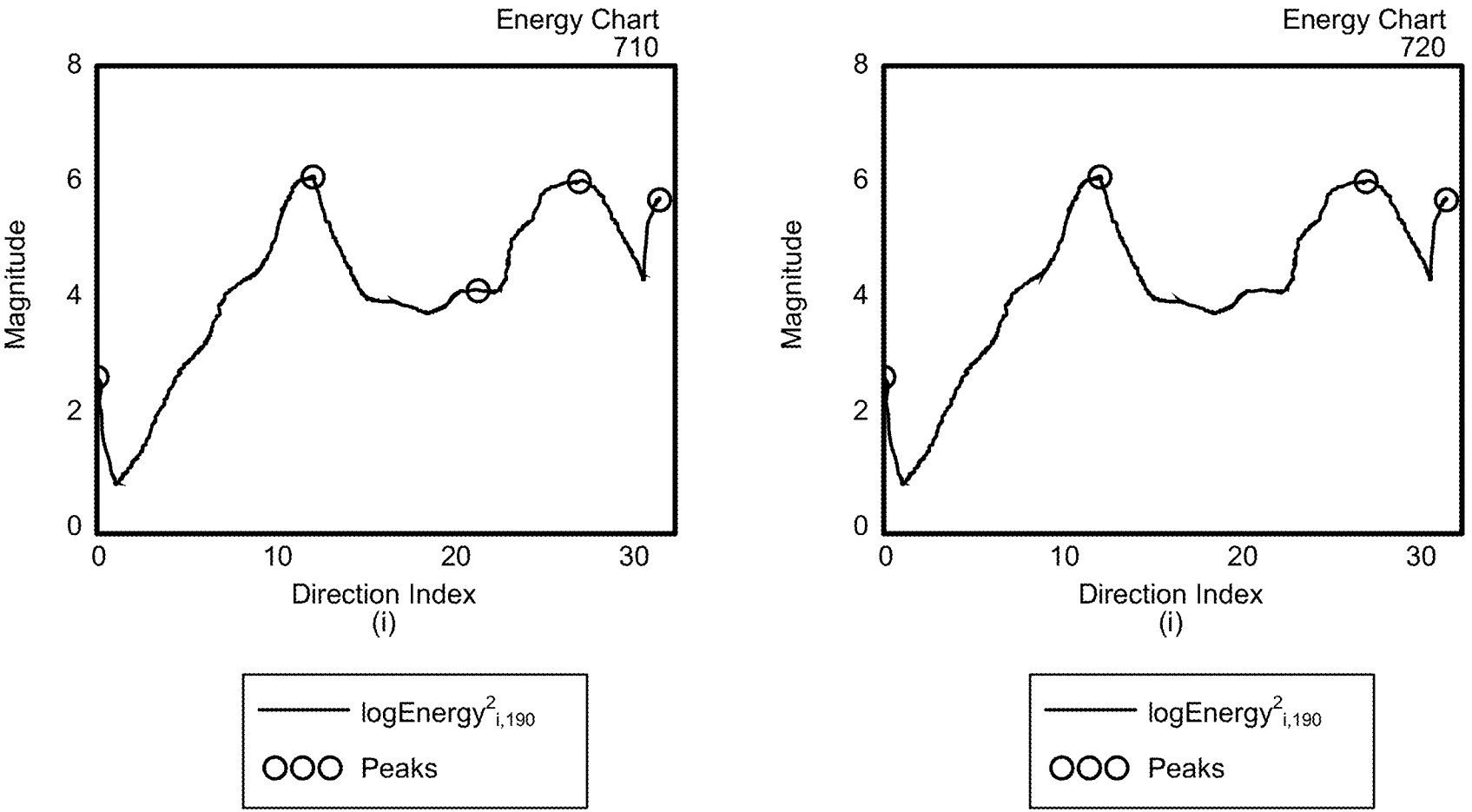
FIG. 7 illustrates an example of identifying peaks in the energy chart and removing shallow peaks according to examples of the present disclosure.

FIG. 7 illustrates an example of identifying peaks in the energy chart and removing shallow peaks according to examples of the present disclosure. As illustrated in FIG. 7, energy chart 710 corresponds to a single frame index n (e.g., frame index 190 illustrated in energy chart 610), with direction index i represented along the horizontal axis (e.g., x-axis) and a magnitude of the energy (e.g., $\log(\text{Energy}^2)$) represented along the vertical axis (e.g., y-axis). For frame index 190, the device 110 may initially detect 5 distinct peaks, with a first peak corresponding to direction index 0, a second peak corresponding to direction index 11, a third peak corresponding to direction index 21, a fourth peak corresponding to direction index 27, and a fifth peak corresponding to direction index 32.

If the device 110 detects five peaks, the device 110 may determine that there are five unique audio sources and may therefore generate output audio data for each of the audio sources. For example, the device 110 may perform the techniques disclosed herein five separate times (e.g., using direction indexes 0, 11, 21, 27 and 32 as target direction indexes) to determine a lower boundary and an upper boundary associated with each of the peaks.

In some examples, multiple peaks may correspond to a single audio source (e.g., both direction index 21 and direction index 27 may correspond to a single audio source) and/or a peak may correspond to a weak audio source (e.g., direction index 21 may correspond to a weak audio source). Therefore, to improve the output audio data, the device 110 may remove shallow peaks. For example, the device 110 may apply a two-step process that includes a first step of identifying all potential peaks in the energy chart 710 and then a second step of removing any peaks that are determined to be too shallow based on a threshold value.

FIG. 7 illustrates an example of removing a shallow peak. As illustrated in FIG. 7, energy chart 710 includes the five peaks mentioned above (e.g., five peaks corresponding to direction index 0, direction index 11, direction index 21, direction index 27, and direction index 32, respectively). The device 110 may detect all five peaks during the first step of the two-step process. However, during the second step, the device 110 may determine that the third peak corresponding to direction index 21 is too shallow and may remove this peak. Therefore, energy chart 720 illustrates that the device 110 selects only four peaks (e.g., four peaks corresponding to direction index 0, direction index 11, direction index 27, and direction index 32, respectively).

To illustrate an example of a technique used to remove shallow peaks, the device 110 may determine a maximum magnitude (e.g., peak value) for each peak and may determine a left bound and a right bound for each peak based on the maximum magnitude. For example, the device 110 may multiply the maximum magnitude by a first parameter (e.g., value between 0 and 1 or a percentage) to determine a threshold value and may identify the left bound and the right bound based on the threshold value. Thus, for the second peak corresponding to direction index 11, the device 110 may determine a first maximum magnitude (e.g., 6) associated with the second peak, may multiply the first maximum magnitude by a first parameter (e.g., 80%) to determine a first threshold value (e.g., 4.8), may search to the left of the second peak to determine the lower bound (e.g., direction index 10 roughly corresponds to the first threshold value of 4.8), and may search to the right of the second peak to determine the upper bound (e.g., direction index 13 roughly corresponds to the first threshold value of 4.8).

The device 110 may then determine whether the peak is too broad (e.g., too shallow) based on the lower bound and the upper bound. For example, the device 110 may determine a width of the peak using the left bound and the right bound and determine if the width exceeds a maximum peak width threshold. Thus, the device 110 may determine that the second peak has a width of 3 direction indexes (e.g., difference between direction index 13 and direction index 10), which is below a maximum peak width threshold (e.g., 10, to illustrate an arbitrary example). As a result, the device 110 may determine that the second peak satisfies a condition and therefore corresponds to an audio source.

Similarly, for the third peak corresponding to direction index 21, the device 110 may determine a second maximum magnitude (e.g., 4) associated with the third peak, may multiply the second maximum magnitude by the first parameter (e.g., 80%) to determine a second threshold value (e.g., 3.2), may search to the left of the third peak to determine the lower bound (e.g., direction index 6 roughly corresponds to the second threshold value of 3.2), and may search to the right of the third peak to determine the upper bound (e.g., there isn't a direction index below the second threshold value of 3.2 to the right of the third peak). The device 110 may then determine that the third peak has a width of 26+direction indexes (e.g., difference between direction index 32 and direction index 6), which is above a maximum peak width threshold (e.g., 10). As a result, the device 110 may determine that the third peak does not satisfy the condition and therefore does not correspond to an audio source, as illustrated by the third peak being removed from energy chart 720.

For ease of explanation, the above examples illustrated specific parameters and threshold values to provide a visual illustration of removing shallow peaks. However, these parameters are not limited thereto and may vary without departing from the disclosure. For example, the first parameter may be any value between 0 and 1 (or a percentage) without departing from the disclosure. Additionally or alternatively, the maximum peak width threshold may depend on the number of direction indexes and may vary without departing from the disclosure. Additionally or alternatively, while the examples above refer to the maximum peak width threshold corresponding to a number of direction indexes, the disclosure is not limited thereto and the maximum peak width threshold may correspond to an azimuth value or the like without departing from the disclosure.

While FIG. 7 illustrates an example of determining the target direction index based on peaks within the directional vector data, the disclosure is not limited thereto and the device 110 may determine the target direction index using any technique known to one of skill in the art without departing from the disclosure.

In some examples, the target direction index may correspond to an audio source. For example, the device 110 may identify a location of an audio source relative to the device and may determine a target azimuth 540 based on the location. Thus, reference lag calculation 542 may receive the target azimuth 540 and may determine the target direction index that includes the target azimuth 540. For example, a target azimuth 540 corresponding to 60 degrees would be associated with direction index 11, which ranges from roughly 56 degrees to roughly 62 degrees (e.g., center point of roughly 59 degrees+/−a threshold value of 2.8 degrees).

If there are multiple audio sources, the device 110 may determine multiple target azimuths and/or multiple target direction indexes. For example, the device 110 may isolate audio data correlated with each audio source and generate unique output audio data for each audio source. Thus, the device 110 would perform first audio processing, using a first target azimuth 540*a* corresponding to the first audio source, to generate first output audio data associated with the first audio source, and perform second audio processing, using a second target azimuth 540*b* corresponding to a second audio source, to generate second output audio data associated with the second audio source. To illustrate an example using the energy chart 610, frame index 100 corresponds to a first audio source at roughly 60 degrees and a second audio source at roughly 150 degrees. Therefore, the device 110 may generate first output audio data using a first target azimuth 540*a* (e.g., 60 degrees, which corresponds to selecting direction index 11 as a first target direction index) and second output audio data using a second target azimuth 540*b* (e.g., 150 degrees, which corresponds to selecting direction index 27 as a second target direction index).

In some examples, the device 110 may track the location of the audio source over time, such that the target azimuth 540 may vary based on an exact location of the audio source relative to the device 110. Variations in the target azimuth 540 may correspond to movement of the audio source and/or the device 110, as well as changes in an orientation of the device 110. However, the disclosure is not limited thereto and the device 110 may determine a fixed location associated with the audio source (e.g., the target azimuth 540 remains constant over time) without departing from the disclosure.

Additionally or alternatively, while the examples described above refer to the target azimuth 540 corresponding to an audio source, the disclosure is not limited thereto. Instead, the device 110 may select one or more fixed target azimuths without regard to a location of an audio source. Thus, the device 110 may generate output audio data that isolates audio data corresponding to fixed target azimuths without departing from the disclosure. For example, the device 110 may generate four output signals, with a first output signal corresponding to a first target azimuth (e.g., roughly 23 degrees, which corresponds to selecting direction index 5 as a first target direction index), a second output signal corresponding to a second target azimuth (e.g., roughly 68 degrees, which corresponds to selecting direction index 13 as a second target direction index), a third output signal corresponding to a third target azimuth (e.g., roughly 113 degrees, which corresponds to selecting direction index 21 as a third target direction index), and a fourth output signal corresponding to a fourth target azimuth (e.g., roughly 158 degrees, which corresponds to selecting direction index 29 as a fourth target direction index). Using this approach, the device 110 effectively separates a range of 180 degrees into four separate sections. However, instead of generating uniform sections using linear techniques (e.g., a first section ranging from 0-45 degrees, a second section ranging from 45-90 degrees, a third section ranging from 90-135 degrees, and a fourth section ranging from 135-180 degrees), the techniques disclosed herein result in non-uniform sections that are selected based on a correlation with audio data corresponding to the target azimuth. Thus, a first section could be twice the size of the second section or vice versa, depending on which direction indexes are strongly correlated to the first target direction index and the second target direction index.

For ease of illustration, the following description will refer to selecting a single target azimuth 540 associated with a single audio source. However, as discussed above, the device 110 may generate output audio data for multiple audio sources without departing from the disclosure.

Referring back to FIG. 5, the cross-correlation calculation 532 may receive the directional vector data (e.g., vector including a magnitude of energy values corresponding to each direction index for a series of frame indexes) from the energy scan 530 and the target azimuth 540 and/or the target direction index from the reference lag calculation 542 and may generate cross-correlation data by performing a cross-correlation between each of the direction indexes and the target direction index. For example, if direction index 11 is selected as the target direction index, the cross-correlation calculation 532 may perform a first cross-correlation between direction index 1 and direction index 11, a second cross-correlation between direction index 2 and direction index 11, and so on for each of the 32 direction indexes.

Figure 8:
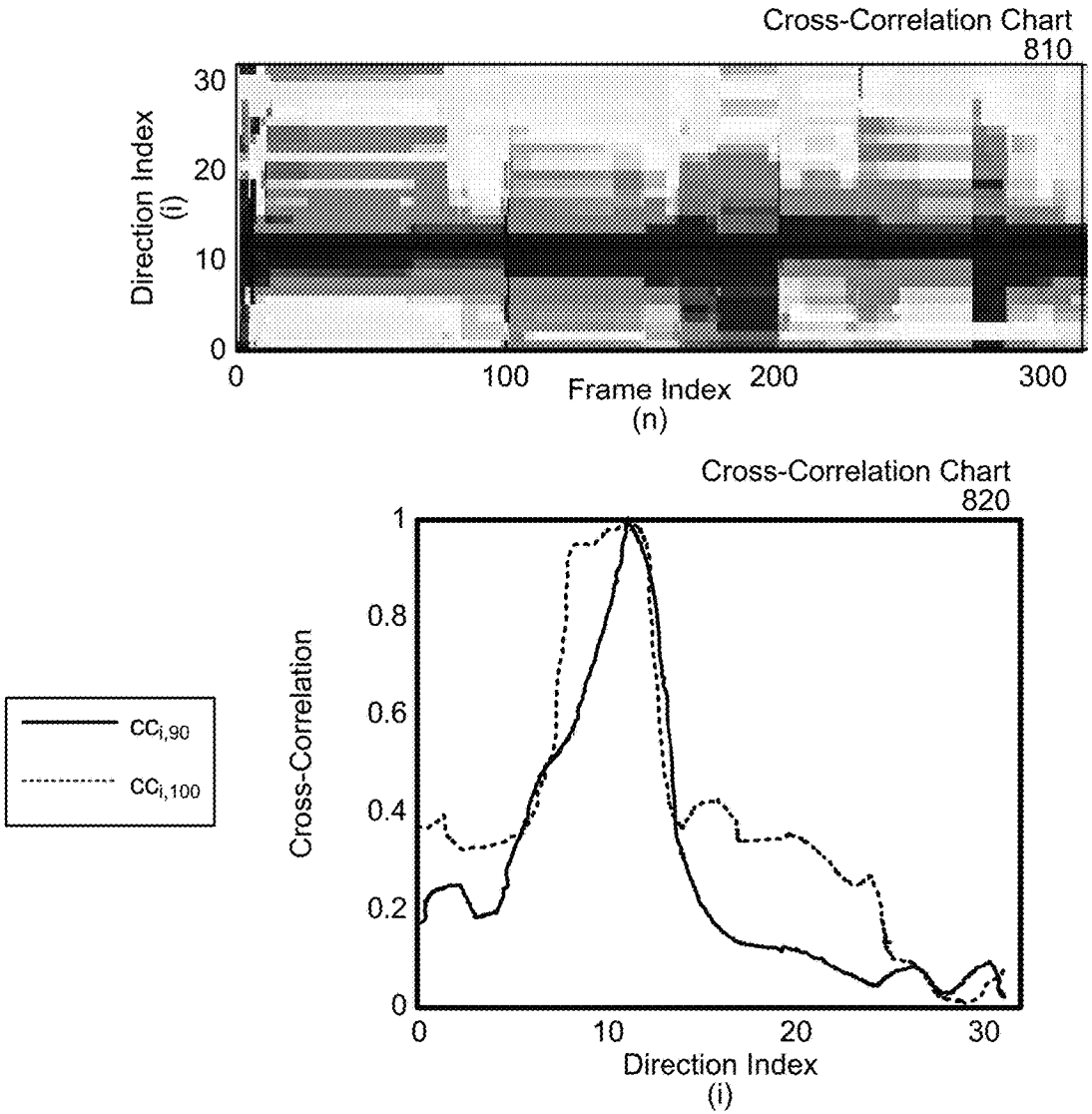
FIG. 8 illustrates an example of a cross-correlation chart representing cross-correlations between energy values associated with a target direction with respect to energy values associated with direction indexes according to examples of the present disclosure.

FIG. 8 illustrates an example of a cross-correlation chart representing cross-correlations between energy values associated with a target direction with respect to energy values associated with direction indexes according to examples of the present disclosure. As illustrated in FIG. 8, a cross-correlation chart 810 may represent time (e.g., via frame index n) along the horizontal axis (e.g., x-axis) and may represent a direction of arrival (e.g., via direction index i) along the vertical axis (e.g., y-axis), with a magnitude of the cross-correlation represented by a color between white (e.g., low magnitude) and black (e.g., high magnitude). As illustrated in the cross-correlation chart 810, high correlation values are represented by black, low correlation values are represented by white, and intermediate correlation values are represented by varying shades of gray between white and black. As discussed above, the cross-correlation chart 810 includes 32 unique direction indexes (e.g., i=1, 2, . . . 32), such that each direction index corresponds to a range of 5.6 degrees. In the cross-correlation chart 810 illustrated in FIG. 8, the target index corresponds to direction index 11.

To illustrate an example, energy values (e.g., energy squared values) may be smoothed in time and then the device 110 may calculate cross-correlation values between the target direction index and a given direction index. For example, the device 110 may determine a first energy value (e.g., Energy[i,n]) associated with direction index 1 (e.g., given direction index) at a current frame index n. Given a first existing smoothed energy squared value (e.g., a smoothed energy squared value associated with a previous frame index n−1, which can be represented as $Energy_s^2[i, n-1]$) associated with direction index 1, the device 110 may generate a first product by applying a first smoothing parameter $\lambda_1$ (e.g., first weight given to previous smoothed energy squared values) to the first existing smoothed energy squared value (e.g., $Energy_s^2[i,n-1]$), may generate a second product by multiplying a second smoothing parameter $\lambda_2$ (e.g., second weight given to current energy values) by a square of the first energy value (e.g., Energy[i,n]$^2$), and may determine a first current smoothed energy squared value (e.g., Energy$_s^2$[i,n]) by summing the first product and the second product.

Thus, in some examples the first current smoothed energy value may be determined using the following equations:

$$\text{Energy}_s^2[i,n]=\lambda_1*\text{Energy}_s^2[i,n-1]+\lambda_2*\text{Energy}[i,n]^2 \quad [6.1]$$

$$\lambda_2=1.0-\lambda_1 \quad [6.2]$$

where Energy$_s^2$[i,n] corresponds to a smoothed energy squared value (e.g., first current smoothed energy squared value) associated with a specific direction index i (e.g., direction index 1) and frame index n (e.g., current frame index), $\lambda_1$ corresponds to the first smoothing parameter that indicates a first weight given to previous smoothed energy values, Energy$_s^2$[i,n−1] corresponds to a smoothed energy squared value (e.g., first existing smoothed energy squared value) associated with the specific direction index i (e.g., direction index 1) and frame index n−1 (e.g., previous frame index), $\lambda_2$ corresponds to the second smoothing parameter that indicates a second weight given to current energy values, and Energy[i, n] corresponds to a current energy value (e.g., first energy value) associated with the specific direction index i (e.g., direction index 1) and the frame index n (e.g., current frame index).

The first smoothing parameter $\lambda_1$ and the second smoothing parameter $\lambda_2$ may be complements of each other, such that a sum of the first smoothing parameter and the second smoothing parameter is equal to one. The first smoothing parameter is a coefficient representing the degree of weighting decrease, a constant smoothing factor between 0 and 1. Increasing the first smoothing parameter $\lambda_1$ decreases the second smoothing parameter $\lambda_2$ and discounts older observations slower, whereas decreasing the first smoothing parameter $\lambda_1$ increases the second smoothing parameter $\lambda_2$ and discounts older observations faster. Thus, the device 110 may determine an amount of smoothing to apply based on a value selected for the first smoothing parameter $\lambda_1$. For example, selecting a value of 0.9 for the first smoothing parameter $\lambda_1$ results in a value of 0.1 for the second smoothing parameter $\lambda_2$, indicating that 90% of the first current smoothed energy squared value is based on the first existing smoothed energy squared value and 10% of the first current smoothed energy value is based on the first energy value.

Using Equation [6.1] or similar techniques known to one of skill in the art, the device 110 may apply smoothing over time to each of the direction indexes, including the target direction index, to generate smoothed energy squared values.

The device 110 may then calculate the cross-correlation data based on the energy values associated with each of the direction indexes over a period of time. For example, the device 110 may determine the cross-correlation between direction index i and target direction index it using the following equation:

$$CC[i,n]=(\text{Energy}[i]*\text{Energy}[i_t])[n] \quad [7.1]$$

where CC [i, n] corresponds to a cross-correlation value that is associated with frame index n (e.g., current frame index) and corresponds to a cross-correlation between direction index i (e.g., direction index 1) and the target direction index it (e.g., direction index 11), Energy[i] corresponds to a first series of energy values associated with the direction index i (e.g., direction index 1) and the frame index n (e.g., Energy[i] includes a series of m frame indexes, ending with a current frame index n), Energy[$i_t$] corresponds to a second series of energy values associated with the target direction index it (e.g., direction index 11) and the frame index n (e.g., Energy[$i_t$] includes a series of m frame indexes, ending with the current frame index n), and * is the cross-correlation operation.

After determining the cross-correlation values, in some examples the device 110 may also apply smoothing to the cross-correlation values, similar to Equation [6.1] above. For example, the device 110 may apply the first smoothing parameter $\lambda_1$ and the second smoothing parameter $\lambda_2$ to generate a weighted sum of the previous smoothed cross-correlation values (e.g., associated with the previous frame index n−1) and a current cross-correlation value (e.g., associated with frame index n). However, the disclosure is not limited thereto and the device 110 may instead apply smoothing when generating the cross-correlation data itself, using the following equation:

$$CC_s[i,n]=*CC_s[i,n-1]+\lambda_2*(\text{Energy}[i_t]*\text{Energy}[i_t])[n] \quad [7.2]$$

where CC$_s$[i,n] corresponds to a smoothed cross-correlation value that is associated with frame index n (e.g., current frame index) and corresponds to a cross-correlation between the direction index i (e.g., direction index 1) and the target direction index it (e.g., direction index 11), $\lambda_t$ corresponds to the first smoothing parameter that indicates a first weight given to previous smoothed cross-correlation values, CC$_s$[i, n−1] corresponds to a smoothed cross-correlation value that is associated with frame index n−1 (e.g., previous frame index) and corresponds to a cross-correlation between the direction index i (e.g., direction index 1) and the target direction index it (e.g., direction index 11), $\lambda_2$ corresponds to the second smoothing parameter that indicates a second weight given to current cross-correlation values, Energy[i] corresponds to a first energy value associated with the specific direction index i (e.g., direction index 1) and frame index n (e.g., current frame index), Energy[$i_t$] corresponds to a second energy value associated with the target direction index it (e.g., direction index 11) and frame index n (e.g., current frame index), and * is the cross-correlation operation.

After generating the smoothed cross-correlation values, the device 110 may perform a normalization operation to normalize the smoothed cross-correlation values with the energies of the a direction index i and the target direction index it. For example, the device 110 may calculate the normalized cross-correlation values using the following equation:

$$CC_n[i,n]=\frac{CC_s[i,n]}{\sqrt{\text{Energy}_s^2[i,n]*\text{Energy}_s^2[i_t,n]+\delta}} \quad [7.3]$$

where CC$_n$[i,n] corresponds to a normalized cross-correlation value that is associated with frame index n (e.g., current frame index) and corresponds to a normalized cross-correlation between the direction index i (e.g., direction index 1) and the target direction index it (e.g., direction index 11), CC$_s$[i,n] corresponds to a smoothed cross-correlation value that is associated with the frame index n and corresponds to a cross-correlation between the direction index i (e.g., direction index 1) and the target direction index it (e.g., direction index 11), Energy$_s^2$[i,n] corresponds to a smoothed energy squared value that is associated with frame index n and the direction index i (e.g., direction index 1), Energy [$i_t$, n] corresponds to a smoothed energy squared value that is associated with frame index n and the target direction index it (e.g., direction index 11), and δ is a small positive value to avoid dividing by zero.

Referring back to FIG. 5, the cross-correlation calculation 532 may output the cross-correlation data to lag boundary determination 534 to determine lag boundaries associated with an audio source. Thus, the lag boundary determination 534 may determine a lower bound and an upper bound associated with the audio source based on the cross-correlation data (received from the cross-correlation calculation 532), the directional vector data (received from the energy scan 530), the target direction index and/or the target azimuth (received from the reference lag calculation 542), and/or the like. For example, the device 110 may identify regions of strong correlation (e.g., regions of black in the cross-correlation chart 810) and may use a correlation threshold value to select direction indexes that are strongly correlated with the audio source (e.g., direction indexes for which a correlation value exceeds the correlation threshold value).

As illustrated in FIG. 8, cross-correlation chart 820 illustrates two cross-correlation signals. A first cross-correlation signal corresponds to cross-correlation values associated with frame index 90, and is represented by a solid line that reaches a peak roughly around direction index 11 and slopes downward on either side. If the device 110 uses a first correlation threshold value (e.g., 0.8), the device 110 may determine that a lower bound for the first cross-correlation signal corresponds to direction index 10 and an upper bound for the first cross-correlation signal corresponds to direction index 13. Thus, the device 110 may determine that direction indexes 10-13 are associated with a first audio source for frame index 90. However, if the device 110 uses a second correlation threshold value (e.g., 0.5), the device 110 may determine that a lower bound for the first cross-correlation signal corresponds to direction index 7 and an upper bound for the first cross-correlation signal corresponds to direction index 13. Thus, the device 110 may instead determine that direction indexes 7-13 are associated with the first audio source for frame index 90.

A second cross-correlation signal corresponds to cross-correlation values associated with frame index 100, and is represented by a dashed line that reaches a broader peak between direction indexes 8-12, sloping downward on either side. If the device 110 uses the first correlation threshold value (e.g., 0.8), the device 110 may determine that a lower bound for the second cross-correlation signal corresponds to direction index 8 and an upper bound for the second cross-correlation signal corresponds to direction index 12. Thus, the device 110 may determine that direction indexes 8-12 are associated with the first audio source for frame index 100. However, if the device 110 uses the second correlation threshold value (e.g., 0.5), the device 110 may determine that a lower bound for the second cross-correlation signal corresponds to direction index 7 and an upper bound for the second cross-correlation signal corresponds to direction index 13. Thus, the device 110 may instead determine that direction indexes 7-13 are associated with the second audio source for frame index 100.

The device 110 may select the correlation threshold value using any techniques known to one of skill in the art without departing from the disclosure. For example, the device 110 may select a fixed correlation threshold value (e.g., 0.8), which remains the same for all cross-correlation data. Additionally or alternatively, the device 110 may vary the correlation threshold value based on the cross-correlation data, a number of audio sources, and/or other variables without departing from the disclosure.

Figure 9:
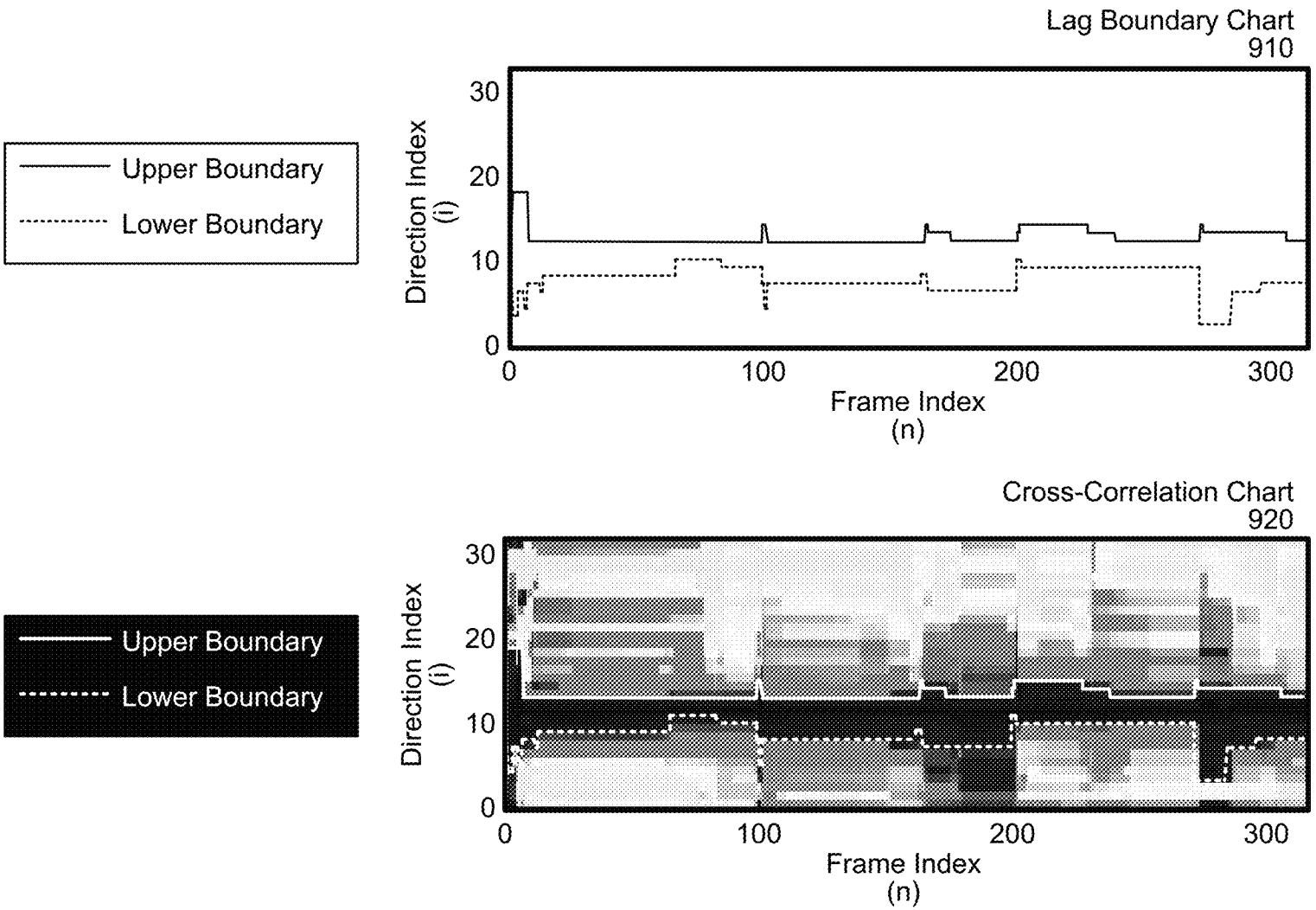
FIG. 9 illustrates an example of deriving lag boundaries based on the cross-correlation data according to examples of the present disclosure.

FIG. 9 illustrates an example of deriving lag boundaries based on the cross-correlation data according to examples of the present disclosure. As illustrated in FIG. 9, lag boundary chart 910 may illustrate a lower boundary (represented by a dashed line) and an upper boundary (represented by a solid line) associated with an audio source. As discussed above, the lag boundary determination 534 may determine the lower boundary and the upper boundary based on where the cross-correlation signals interest the cross-correlation threshold. For example, the lag boundary determination 534 may start at the target direction index associated with the target azimuth 540, which in this example is direction index 11, and may detect where the cross-correlation values fall below the cross-correlation threshold value in direction indexes lower than the target direction index (e.g., lower boundary), and then start at the target direction index and detect where the cross-correlation values fall below the cross-correlation threshold value in direction indexes higher than the target direction index (e.g., upper boundary).

FIG. 9 illustrates cross-correlation chart 920 that illustrates the lower boundary and the upper boundary superimposed on the cross-correlation data. As illustrated in FIG. 9, the lag boundaries correspond to where the cross-correlation values decrease from a high magnitude (represented by black) to a slightly lower magnitude (represented by gray).

In some examples, the device 110 may use the peaks detected in the smoothed energy squared values when deriving the lag boundaries. For example, the device 110 may determine the lag boundaries, as discussed above, but may verify that the lag boundaries are valid if one of the peaks is located within the lag boundaries. Thus, the device 110 may include a verification step that compares the peaks detected in the smoothed energy squared values to the lag boundaries. If no peaks are detected within the lag boundaries, the device 110 will discard the lag boundaries. This may correspond to not detecting an audio source, although the disclosure is not limited thereto.

After generating the lag boundaries and verifying that peak(s) are detected within the lag boundaries, the lag boundary determination 534 may output the lag boundaries to mask generation 550. Mask generation 550 will also receive the lag estimate vector data and/or the direction mask data generated by the lag calculation 520. Using the lag boundaries, the lag estimate vector data, and/or the direction mask data, the mask generation 550 may generate a mask corresponding to the audio source. For example, the mask generation 550 may generate mask data that combines the direction mask data for each direction index included within the lag boundaries.

As described in greater detail above, the direction mask data indicates whether a particular frequency band corresponds to a particular direction index. Thus, if the lag boundaries correspond to a lower bound of direction index 10 and an upper bound of direction index 13, the mask generation 550 may generate mask data including each of the frequency bands associated with direction indexes 10-13 (e.g., each of the frequency bands that have an estimated lag value corresponding to the direction indexes 10-13). In some examples, the mask data may be smoothed using techniques known to one of skill in the art, such as by applying a triangular window or the like, although the disclosure is not limited thereto.

Figure 10A:
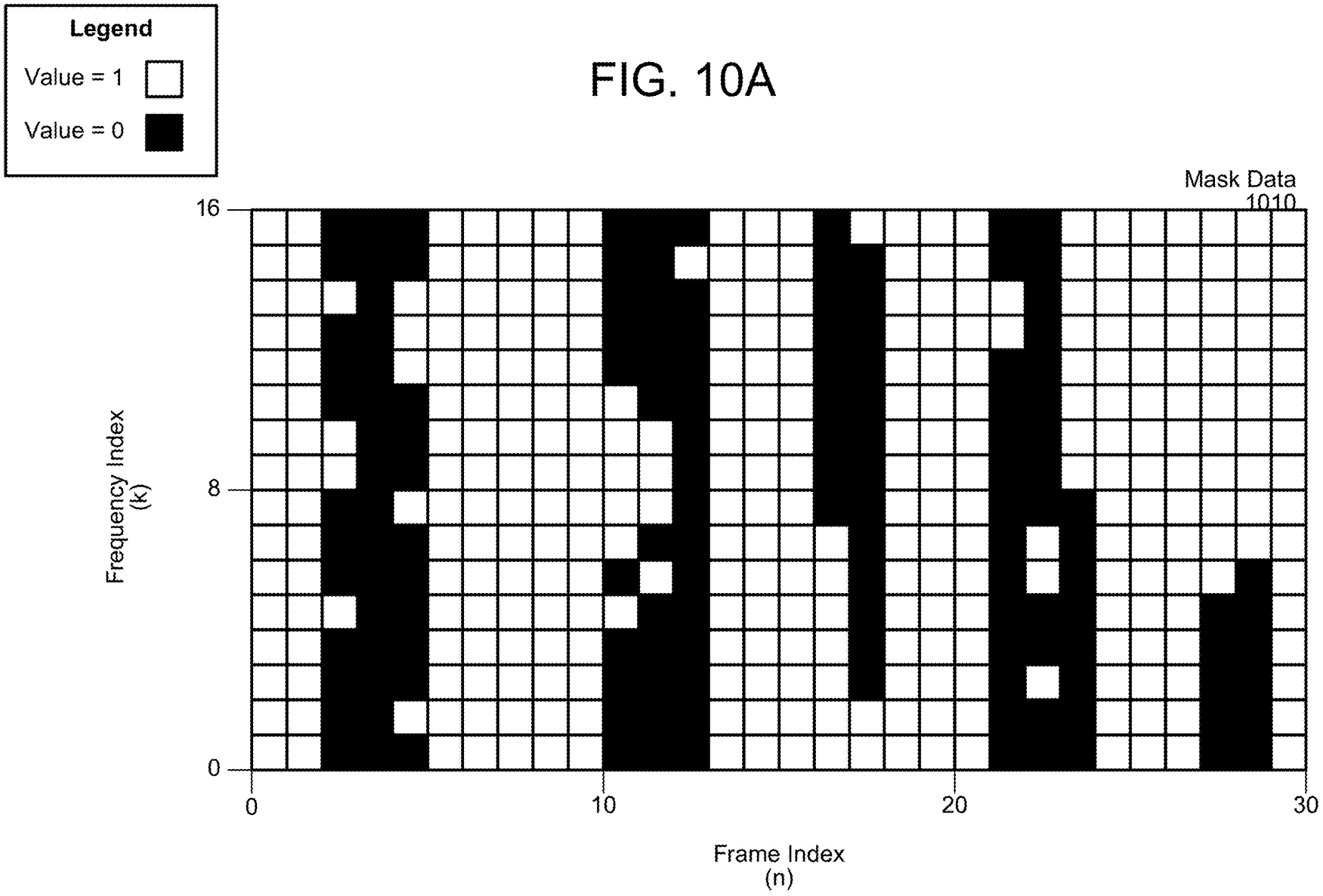
FIGS. 10A-10B illustrate examples of mask data generated according to examples of the present disclosure.
Figure 10B:
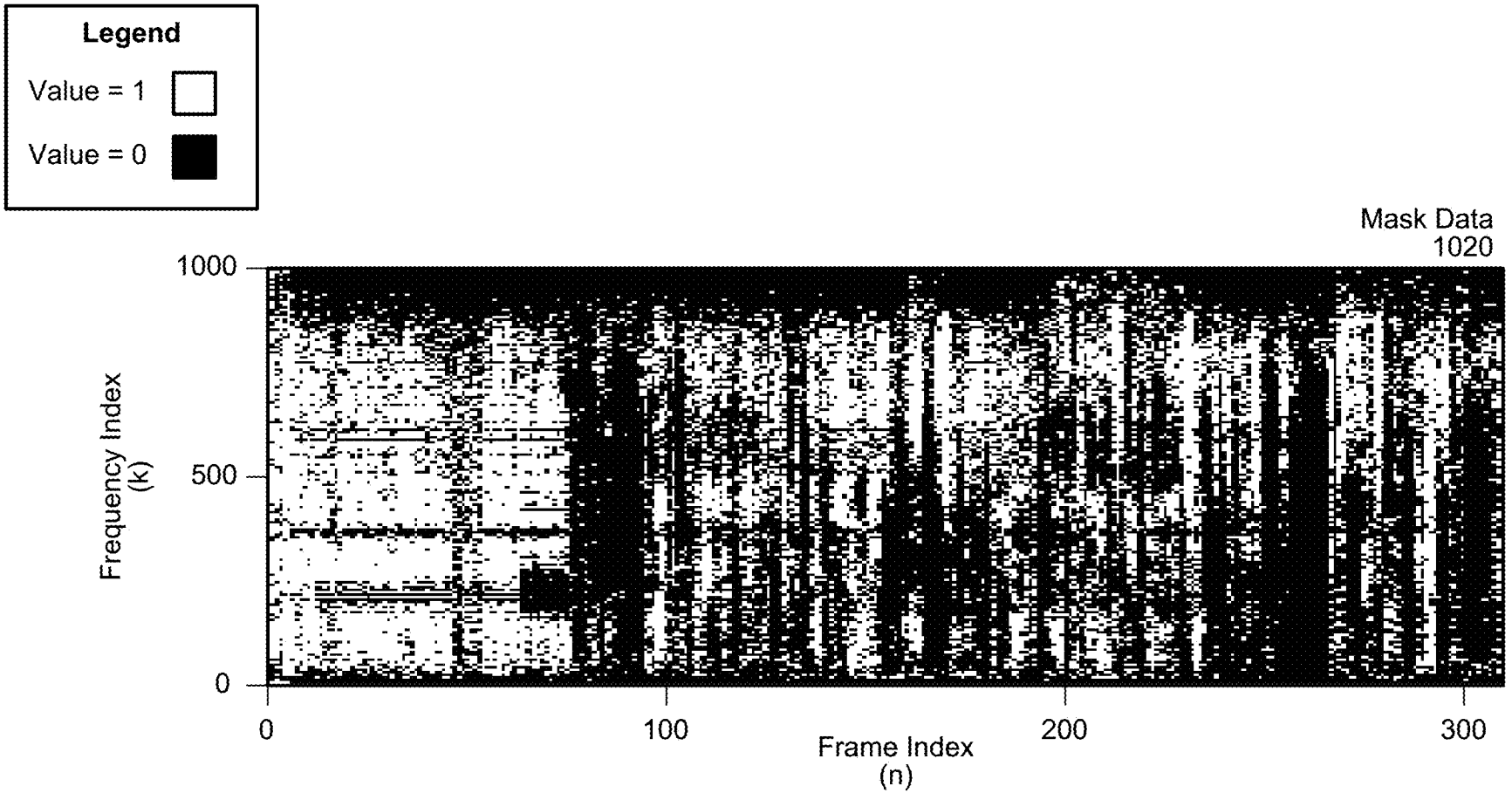

FIGS. 10A-10B illustrate examples of mask data generated according to examples of the present disclosure. As illustrated in FIG. 10A, the device 110 may generate mask data 1010 that indicates individual frequency indexes k and frame indexes n that are associated with an audio source. For example, the device 110 may determine lag boundaries indicating a range of direction indexes i that are associated with the audio source and the mask data may indicate a plurality of frequency indexes k that correspond to this range of direction indexes i. The mask data 1010 indicates frequency indexes k along the vertical axis and frame indexes n along the horizontal axis.

As illustrated in FIG. 10A, a value of one is represented in the mask data 1010 as a white cell, whereas a value of zero is represented in the mask data 1010 as a black cell. Thus, a white cell indicates that a particular frequency index k corresponds to the audio source at a particular frame index n, whereas a black cell indicates that the particular frequency index k does not correspond to the audio source at the particular frame index n.

For ease of illustration, the mask data 1010 illustrated in FIG. 10A only corresponds to a portion of the total mask data. For example, the mask data 1010 only includes a narrow range of frequency indexes k (e.g., 16 frequency bands) and frame indexes n (e.g., 30 frame indexes) in order to accurately represent individual cells corresponding to a specific frequency index k and frame index n. However, the disclosure is not limited thereto and the device 110 may determine mask values for any number of frequency indexes k and/or frame indexes n without departing from the disclosure. For example, FIG. 10B illustrates mask data 10J20 corresponding to 1000 frequency indexes and over 300 frame indexes, although the device 110 may generate mask data for any number of frequency indexes and/or frame indexes without departing from the disclosure.

While FIGS. 10A-10B illustrate the mask data as binary masks, the disclosure is not limited thereto and the mask data may correspond to continuous values without departing from the disclosure. For example, white may represent a mask value of one (e.g., strong correlation with the audio source), black may represent a mask value of zero (e.g., weak correlation with the audio source), and varying shades of gray representing intermediate mask values between zero and one (e.g., medium correlation with the audio source).

In the example illustrated in FIG. 5, the first modified audio signal and the second modified audio signal are input to output generation 560, which generates a first output audio signal corresponding to an entire frequency range. The output generation 560 may generate the first output audio signal using any technique known to one of skill in the art without departing from the disclosure. For example, the output generation 560 may perform a mean operation to determine an average of the first modified input signal and the second modified input signal, although the disclosure is not limited thereto.

Multiplier 570 may apply the mask data to the first output audio signal to generate second output audio signal that corresponds to a single audio source. For example, the multiplier 570 may apply the mask data to the first output audio signal so that the second output audio data only includes a portion of the first output audio signal that corresponds to the frequency bands associated with direction indexes 10-13.

As discussed above, the device 110 may generate a unique output audio signal for each audio source. For example, mask generation 550 may generate first mask data associated with a first audio source and may generate second mask data associated with a second audio source. Thus, the multiplier 570 may apply the first mask data to the first output audio signal to generate the second output audio signal that is associated with the first audio source while also applying the second mask data to the first output audio signal to generate a third output audio signal that is associated with the second audio source. However, the number of audio sources and/or output audio signals is not limited thereto and may vary without departing from the disclosure.

The multiplier 570 may output each of the output audio signals to an Inverse Discrete Fourier Transform (IDFT) 580, which may perform IDFT to convert back from the frequency domain to the time domain. For example, the multiplier 570 may output the second output audio signal to the IDFT 580 and the IDFT 580 may generate third output audio signal based on the second output audio signal. The IDFT 580 may output the third output audio signal to windowing and overlap-add (OLA) 590, which may combine the third output audio signal with previous output signals to generate output signal 592 as a final output. Thus, the output signal 592 corresponds to isolated audio data associated with an individual audio source. If the device 110 detects multiple audio sources, the device 110 may generate a unique output signal 592 for each audio source (e.g., first output signal 592*a* for a first audio source, second output signal 592*b* for a second audio source, etc.).

Figure 11:
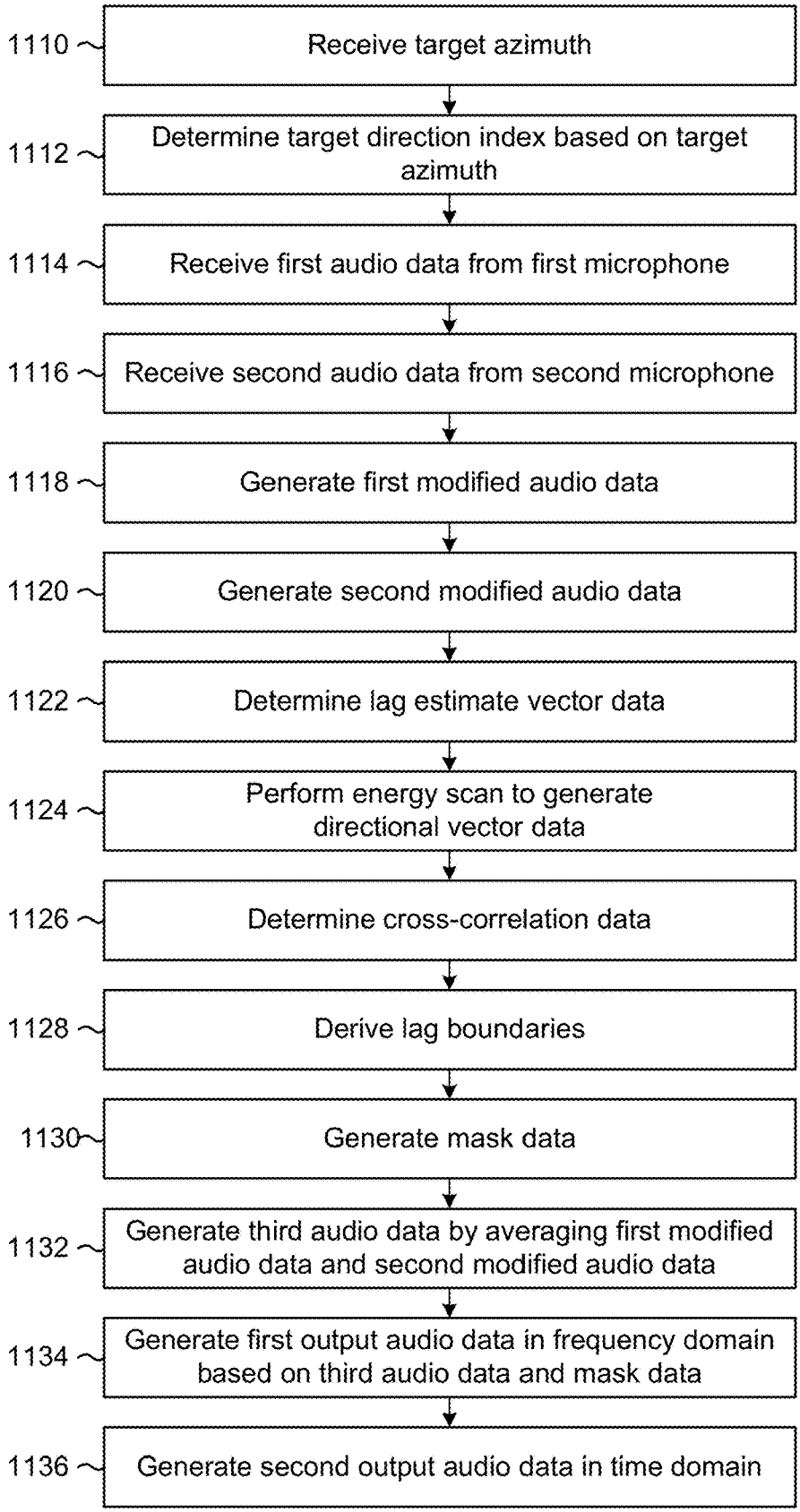
FIG. 11 is a flowchart conceptually illustrating a method for performing directional speech separation according to examples of the present disclosure.

FIG. 11 is a flowchart conceptually illustrating a method for performing directional speech separation according to examples of the present disclosure. As illustrated in FIG. 11, the device 110 may receive (1110) a target azimuth value and may determine (1112) a target direction index based on the target azimuth value.

The device 110 may receive (1114) first audio data from a first microphone, may receive (1116) second audio data from a second microphone, may generate (1118) first modified audio data from the first audio data and may generate (1120) second modified audio data from the second audio data. For example, the first audio data and the second audio data may be in a time domain, whereas the first modified audio data and the second modified audio data may be in a frequency domain.

The device 110 may determine (1122) lag estimate vector data (e.g., lag estimate data) based on the first modified audio data and the second modified audio data, may perform (1124) an energy scan to generate directional vector data, may determine (1126) cross-correlation data, may derive (1128) lag boundaries and may generate (1130) mask data based on the lag boundaries, as described above with regard to FIG. 5. For example, the lag estimate vector data may determine lag estimate values between the first modified audio data and the second modified audio data for each frequency band, and the directional vector data may associate individual frequency bands with a particular direction index based on the estimated lag values.

The device 110 may generate (1132) third audio data by averaging the first modified audio data and the second modified audio data, may generate (1134) first output audio data in a frequency domain based on the third audio data and the mask data, and may generate (1136) second output audio data in a time domain based on the first output audio data. For example, the third audio data may correspond to an output of the output generation 560, the first output audio data may correspond to an output of the multiplier 570, and the second output audio data may correspond to the output signal 592.

Figure 12:
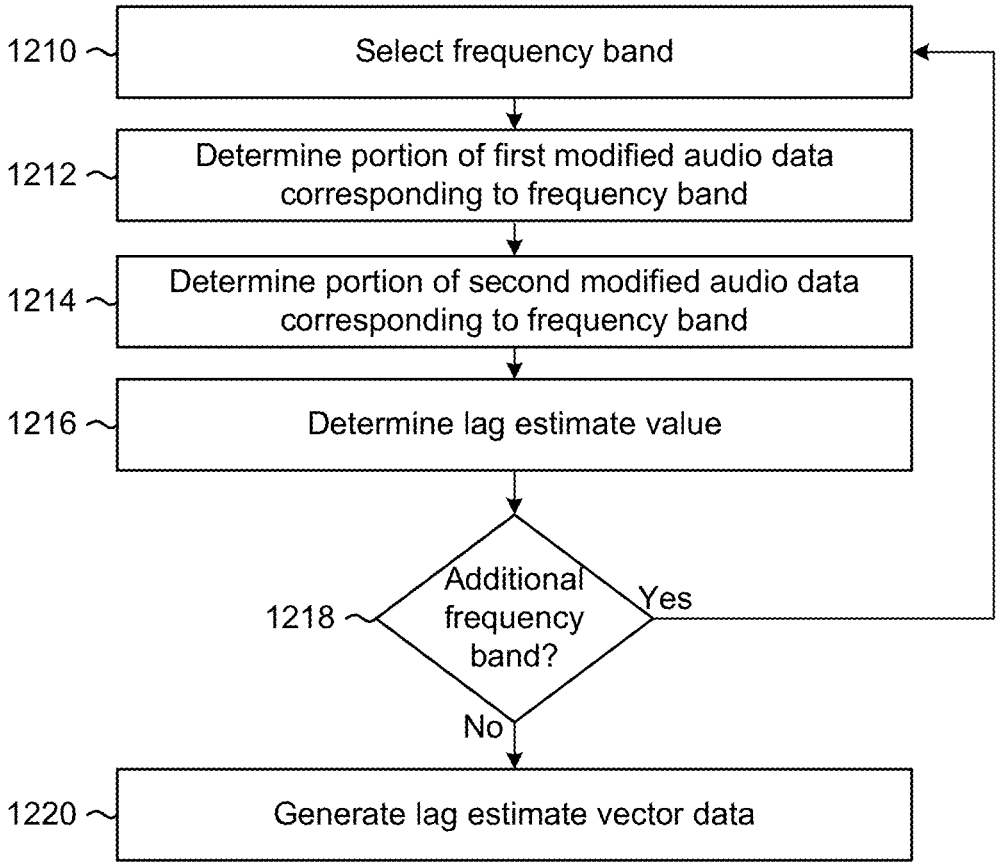
FIG. 12 is a flowchart conceptually illustrating a method for determining lag estimate values according to examples of the present disclosure.

FIG. 12 is a flowchart conceptually illustrating a method for determining lag estimate values according to examples of the present disclosure. As illustrated in FIG. 12, the device 110 may select (1210) a frequency band (e.g., frequency index k), may determine (1212) a first portion of the first modified audio data corresponding to the frequency band, may determine (1214) a second portion of the second modified audio data corresponding to the frequency band, and may determine (1216) a lag estimate value based on the first portion and the second portion. The device 110 may determine (1218) whether there is an additional frequency band to select, and if so, may loop to 1210 to repeat steps 1210-1218. If there are no additional frequency bands, the device 110 may generate (1220) lag estimate vector data including each of the lag estimate values calculated in step 1216.

Figure 13:
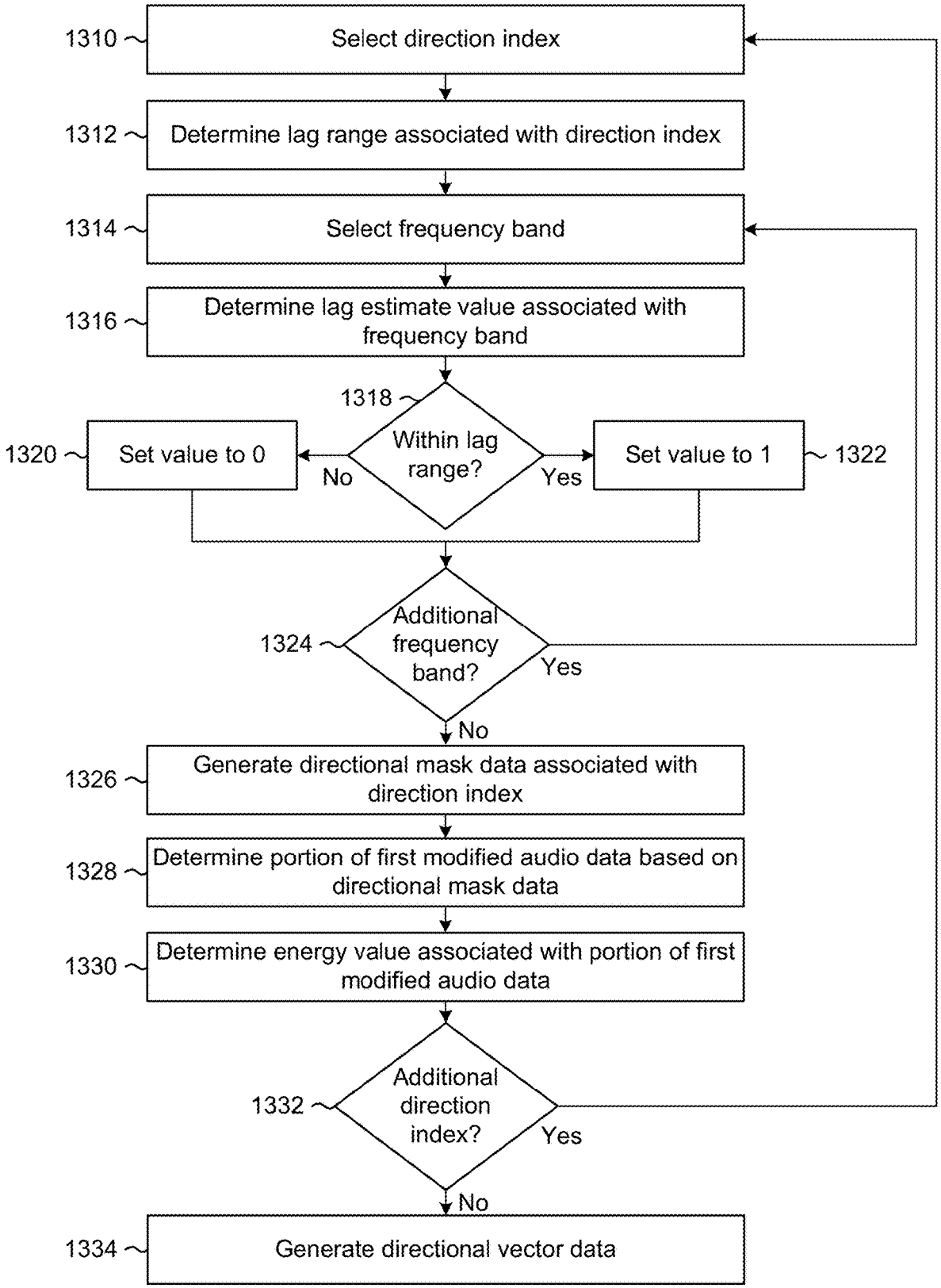
FIG. 13 is a flowchart conceptually illustrating a method for determining energy levels associated with directions according to examples of the present disclosure.

FIG. 13 is a flowchart conceptually illustrating a method for determining energy levels associated with directions according to examples of the present disclosure. As illustrated in FIG. 13, the device 110 may select (1310) a direction index i and may determine (1312) a lag range associated with the direction index. In some examples, the device 110 may determine a lower boundary and an upper boundary associated with the direction index i. However, the disclosure is not limited thereto and in other examples, the device 110 may determine a center point and a lag threshold value associated with the direction index i. Using the center point and the lag threshold value, the device 110 may determine the lower boundary and the upper boundary associated with the direction index i.

The device 110 may select (1314) a frequency band (e.g., frequency index k), may determine (1316) a lag estimate value associated with the frequency band, and may determine (1318) whether the lag estimate value is within the lag range associated with the direction index i. If the lag estimate value is not within the lag range, the device 110 may set (1320) a value within directional mask data to zero, whereas if the lag estimate value is within the lag range, the device 110 may set (1322) the value to one. The device 110 may determine (1324) whether there is an additional frequency band, and if so, may loop to step 1314 to repeat steps 1314-1324.

If there is not an additional frequency band, the device 110 may generate (1326) directional mask data associated with the direction index by combining each of the values determined in steps 1320 and 1322 for corresponding frequency bands. The device 110 may then determine (1328) a portion of the first modified audio data based on the directional mask data, and may determine (1330) an energy value associated with the portion of the first modified audio data. For example, the device 110 may determine the energy value for frequency bands associated with the direction index based on the directional mask data, as discussed above with regard to FIG. 5.

The device 110 may determine (1332) whether there is an additional direction index, and if so, may loop to step 1310 to repeat steps 1310-1332. If there are no additional direction indexes, the device 110 may generate (1334) directional vector data by combining the energy values determined in step 1330 for each of the direction indexes.

Figure 14:
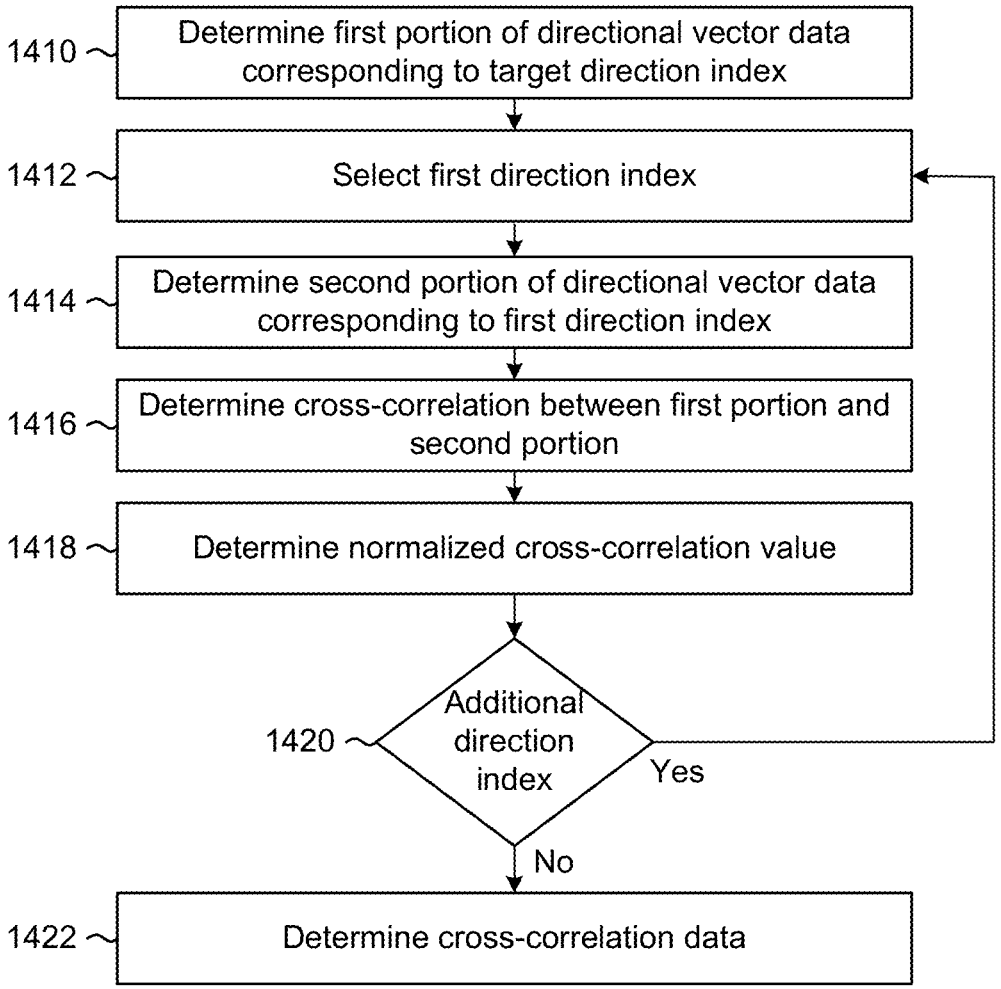
FIG. 14 is a flowchart conceptually illustrating a method for determining cross-correlation data according to examples of the present disclosure.

FIG. 14 is a flowchart conceptually illustrating a method for determining cross-correlation data according to examples of the present disclosure. As illustrated in FIG. 14, the device 110 may determine (1410) a first portion of the directional vector data corresponding to a target direction index. The device 110 may select (1412) a first direction index, may determine (1414) a second portion of the directional vector data corresponding to the first direction index, may determine (1416) a cross-correlation between the first portion and the second portion, and may determine (1418) a normalized cross-correlation value by normalizing the cross-correlation, as discussed in greater detail above with regard to FIG. 5. The directional vector data may include energy values for each frequency index over a period of time. For example, the directional vector data may include a current energy value for a specific frequency index, as well as energy values associated with the specific frequency index over m previous frames. Thus, the directional vector data may include a time sequence for each of the direction indexes, such as m frames of energy values for each direction index i.

The device 110 may determine (1420) whether there is an additional direction index, and if so, may loop to step 1412 to repeat steps 1412-1420. If there are no additional direction indexes, the device 110 may determine (1422) cross-correlation data based on the normalized cross-correlation values determined in step 1418 for each of the direction indexes.

Figure 15:
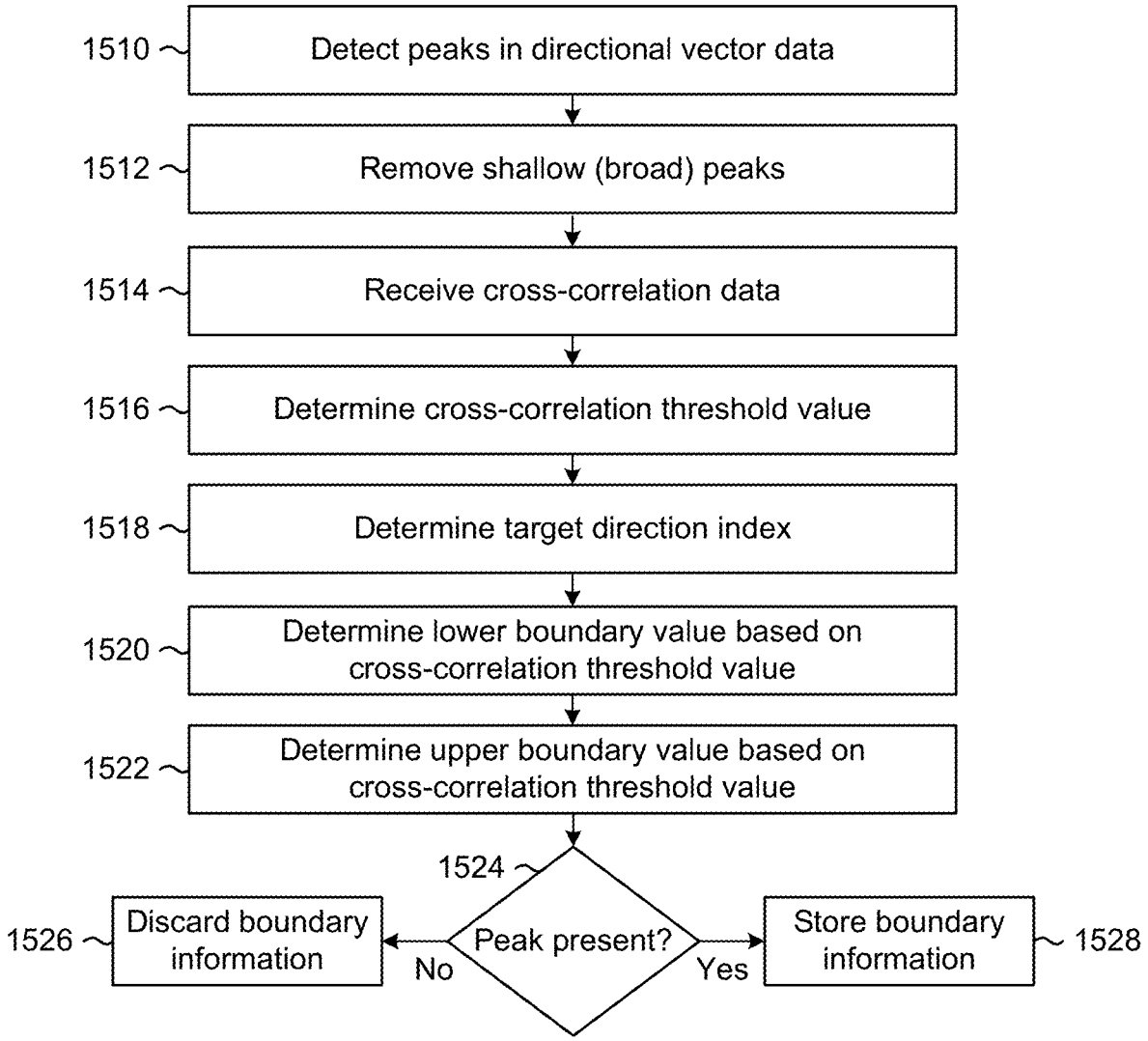
FIG. 15 is a flowchart conceptually illustrating a method for deriving lag boundaries according to examples of the present disclosure.

FIG. 15 is a flowchart conceptually illustrating a method for deriving lag boundaries according to examples of the present disclosure. As illustrated in FIG. 15, the device 110 may detect (1510) peaks in the directional vector data and may remove (1512) shallow (e.g., broad) peaks detected in the directional vector data.

The device 110 may receive (1514) the cross-correlation data, may determine (1516) a cross-correlation threshold value, may determine (1518) a target direction index, may determine (1520) a lower boundary value based on the cross-correlation threshold value and the target direction index, and may determine (1522) an upper boundary value based on the cross-correlation threshold value and the target direction index. For example, the device 110 may start at the target direction index and may detect where cross-correlation values decrease below the cross-correlation threshold value for direction indexes below the target direction index to determine the lower boundary value. Similarly, the device 110 may start at the target direction index and may detect where cross-correlation values decrease below the cross-correlation threshold value for direction indexes above the target direction index to determine the upper boundary value.

After determining the lower boundary value and the upper boundary value, the device 110 may determine (1524) whether a peak is present within the lag boundaries. If a peak is not present, the device 110 may discard (1526) the boundary information, whereas if a peak is present the device 110 may store (1528) the boundary information for a particular audio source and/or frame index n.

Figure 16:
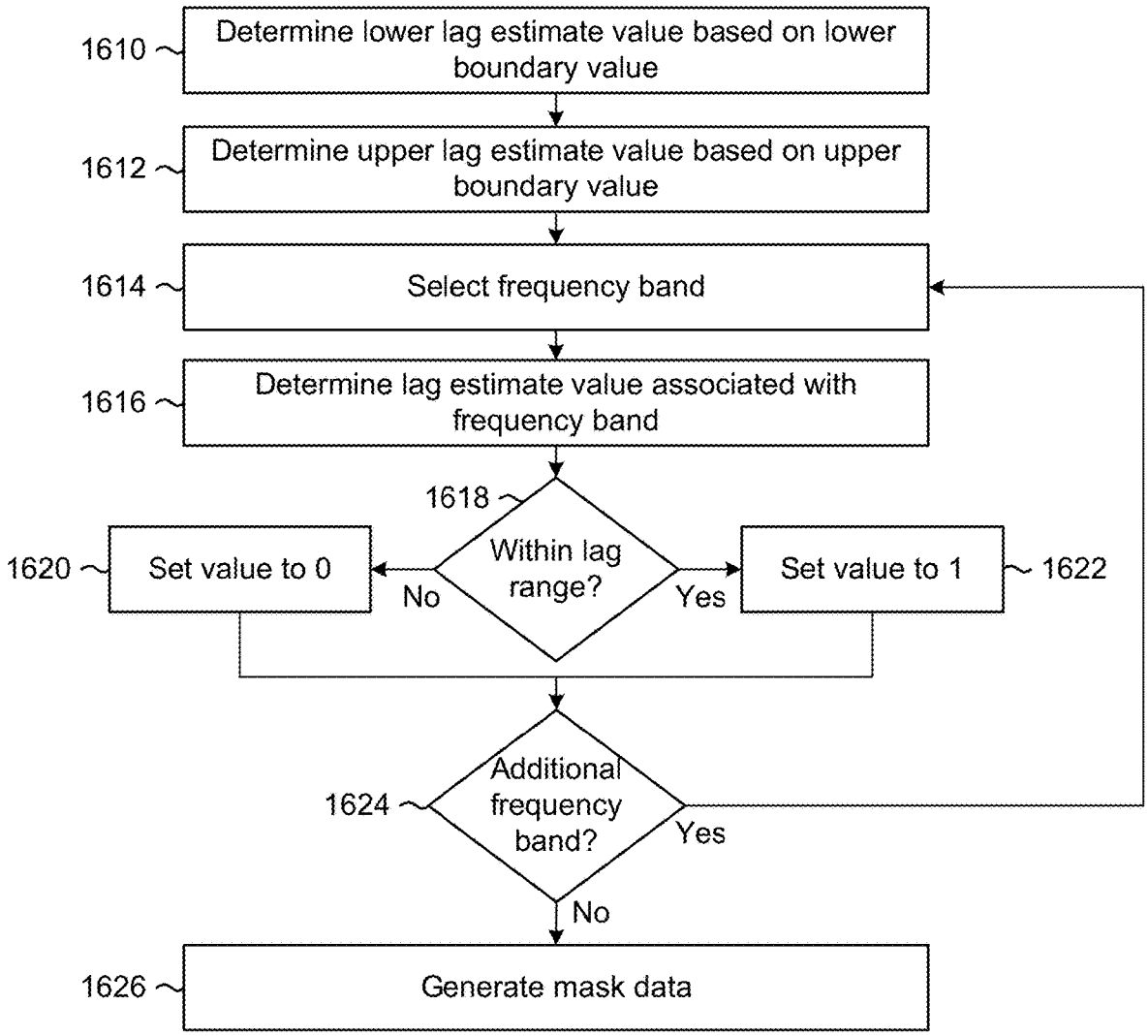
FIG. 16 is a flowchart conceptually illustrating a method for generating mask data according to examples of the present disclosure.

FIG. 16 is a flowchart conceptually illustrating a method for generating mask data according to examples of the present disclosure. As illustrated in FIG. 16, the device 110 may determine (1610) a lower lag estimate value based on the lower boundary value and may determine (1612) an upper lag estimate value based on the upper boundary value. For example, the lower lag estimate value may correspond to a minimum lag estimate value associated with the direction index corresponding to the lower boundary value, whereas the upper lag estimate value may correspond to a maximum lag estimate value associated with the direction index corresponding to the upper boundary value.

The device 110 may select (1614) a frequency band, may determine (1616) a lag estimate value associated with the frequency band, and may determine (1618) whether the lag estimate value is within the lag range determined in steps 1610-1612. If the lag estimate value is not within the lag range, the device 110 may set (1620) a value to zero in the mask data, whereas if the lag estimate value is within the lag range, the device 110 may set (1622) the value to one in the mask data. The device 110 may then determine (1624)

whether there is an additional frequency band and, if so, may loop to step 1614 to repeat steps 1614-1624. If there is not an additional frequency band, the device 110 may generate (1626) mask data by combining the values determined in steps 1620-1622 for each of the frequency bands. Thus, the mask data may indicate individual frequency bands that are associated with the audio source based on the direction indexes indicated by the lag boundaries.

While FIG. 16 illustrates an example of generating the mask data, the disclosure is not limited thereto. Instead, the device 110 may combine the directional vector data associated with each of the directional indexes included between the lower boundary value and the upper boundary value without departing from the disclosure. Additionally or alternatively, the device 110 may generate the mask data using any technique known to one of skill in the art.

While the device 110 may generate the output audio data by applying binary mask data to the microphone audio data, using the binary mask data may result in transients and/or distortion in the output audio data due to abrupt transitions between values of 0 and values of 1. In some examples, the device 110 may smooth binary mask data to generate continuous mask data as part of generating the mask data in step 1626. For example, the binary mask data may correspond to values of 0 (e.g., logic low) or 1 (e.g., logic high), whereas the continuous mask data may correspond to values between 0 and 1 (e.g., 0.0, 0.1, 0.2, etc.). To illustrate an example of smoothing the binary mask data to generate continuous mask data, an abrupt transition in the binary mask data (e.g., [0, 0, 0, 0, 1, 1, 1]) may correspond to a more gradual transition in the continuous mask data (e.g., [0, 0, 0.1, 0.5, 0.9, 1, 1]. In some examples, the device 110 may apply a smoothing mask using a triangular filter bank to smooth the binary mask data across frequencies in order to generate a final representation of the mask data. However, the disclosure is not limited thereto and the device 110 may use any technique known to one of skill in the art without departing from the disclosure.

Figure 17:
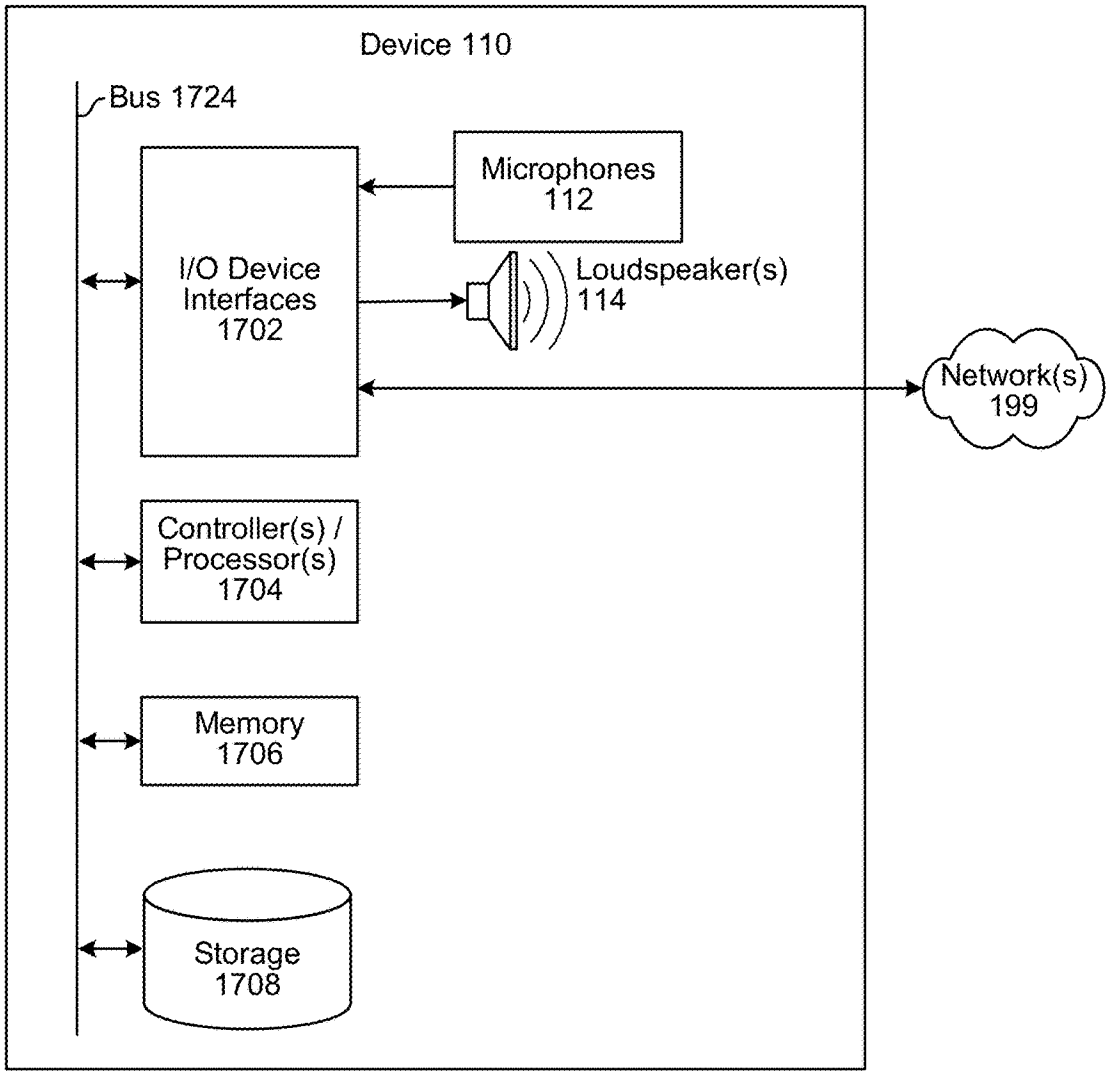
FIG. 17 is a block diagram conceptually illustrating example components of a system according to embodiments of the present disclosure.

FIG. 17 is a block diagram conceptually illustrating example components of a system for directional speech separation according to embodiments of the present disclosure. In operation, the system 100 may include computer-readable and computer-executable instructions that reside on the device 110, as will be discussed further below.

As illustrated in FIG. 17, the device 110 may include an address/data bus 1724 for conveying data among components of the device 110. Each component within the device 110 may also be directly connected to other components in addition to (or instead of) being connected to other components across the bus 1724.

The device 110 may include one or more controllers/processors 1704, which may each include a central processing unit (CPU) for processing data and computer-readable instructions, and a memory 1706 for storing data and instructions. The memory 1706 may include volatile random access memory (RAM), non-volatile read only memory (ROM), non-volatile magnetoresistive (MRAM) and/or other types of memory. The device 110 may also include a data storage component 1708, for storing data and controller/processor-executable instructions (e.g., instructions to perform the algorithm illustrated in FIGS. 1, 11, 12, 13, 14, 15, and/or 16). The data storage component 1708 may include one or more non-volatile storage types such as magnetic storage, optical storage, solid-state storage, etc. The device 110 may also be connected to removable or external non-volatile memory and/or storage (such as a removable memory card, memory key drive, networked storage, etc.) through the input/output device interfaces 1702.

The device 110 includes input/output device interfaces 1702. A variety of components may be connected through the input/output device interfaces 1702. For example, the device 110 may include one or more microphone(s) 112 and/or one or more loudspeaker(s) 114 that connect through the input/output device interfaces 1702, although the disclosure is not limited thereto. Instead, the number of microphone(s) 112 and/or loudspeaker(s) 114 may vary without departing from the disclosure. In some examples, the microphone(s) 112 and/or loudspeaker(s) 114 may be external to the device 110.

The input/output device interfaces 1702 may be configured to operate with network(s) 199, for example a wireless local area network (WLAN) (such as WiFi), Bluetooth, ZigBee and/or wireless networks, such as a Long Term Evolution (LTE) network, WiMAX network, 3G network, etc. The network(s) 199 may include a local or private network or may include a wide network such as the internet. Devices may be connected to the network(s) 199 through either wired or wireless connections.

The input/output device interfaces 1702 may also include an interface for an external peripheral device connection such as universal serial bus (USB), FireWire, Thunderbolt, Ethernet port or other connection protocol that may connect to network(s) 199. The input/output device interfaces 1702 may also include a connection to an antenna (not shown) to connect one or more network(s) 199 via an Ethernet port, a wireless local area network (WLAN) (such as WiFi) radio, Bluetooth, and/or wireless network radio, such as a radio capable of communication with a wireless communication network such as a Long Term Evolution (LTE) network, WiMAX network, 3G network, etc.

The device 110 may include components that may comprise processor-executable instructions stored in storage 1708 to be executed by controller(s)/processor(s) 1704 (e.g., software, firmware, hardware, or some combination thereof). For example, components of the device 110 may be part of a software application running in the foreground and/or background on the device 110. Some or all of the controllers/components of the device 110 may be executable instructions that may be embedded in hardware or firmware in addition to, or instead of, software. In one embodiment, the device 110 may operate using an Android operating system (such as Android 4.3 Jelly Bean, Android 4.4 KitKat or the like), an Amazon operating system (such as FireOS or the like), or any other suitable operating system.

Executable computer instructions for operating the device 110 and its various components may be executed by the controller(s)/processor(s) 1704, using the memory 1706 as temporary "working" storage at runtime. The executable instructions may be stored in a non-transitory manner in non-volatile memory 1706, storage 1708, or an external device. Alternatively, some or all of the executable instructions may be embedded in hardware or firmware in addition to or instead of software.

The components of the device 110, as illustrated in FIG. 17, are exemplary, and may be located a stand-alone device or may be included, in whole or in part, as a component of a larger device or system.

The concepts disclosed herein may be applied within a number of different devices and computer systems, including, for example, general-purpose computing systems, server-client computing systems, mainframe computing systems, telephone computing systems, laptop computers, cellular phones, personal digital assistants (PDAs), tablet computers, video capturing devices, video game consoles, speech processing systems, distributed computing environments, etc. Thus the components, components and/or processes described above may be combined or rearranged without departing from the scope of the present disclosure. The functionality of any component described above may be allocated among multiple components, or combined with a different component. As discussed above, any or all of the components may be embodied in one or more general-purpose microprocessors, or in one or more special-purpose digital signal processors or other dedicated microprocessing hardware. One or more components may also be embodied in software implemented by a processing unit. Further, one or more of the components may be omitted from the processes entirely.

The above embodiments of the present disclosure are meant to be illustrative. They were chosen to explain the principles and application of the disclosure and are not intended to be exhaustive or to limit the disclosure. Many modifications and variations of the disclosed embodiments may be apparent to those of skill in the art. Persons having ordinary skill in the field of computers and/or digital imaging should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Embodiments of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media.

Embodiments of the present disclosure may be performed in different forms of software, firmware and/or hardware. Further, the teachings of the disclosure may be performed by an application specific integrated circuit (ASIC), field programmable gate array (FPGA), or other component, for example.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each is present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

receiving first audio data associated with a first microphone;

receiving second audio data associated with a second microphone;

determining a first lag estimate value corresponding to a time delay between receipt, by the first microphone, of first audio corresponding to a first portion of the first audio data, and receipt, by the second microphone, of second audio corresponding to a second portion of the second audio data, the first portion of the first audio data and the second portion of the second audio data associated with a first frequency range;

determining lag estimate data including the first lag estimate value and a second lag estimate value corresponding to a second frequency range;

determining, based on the first audio data and the lag estimate data, a first energy value associated with a first direction;

determining a first energy series associated with the first direction, the first energy series including a sequence of energy values over time ending with the first energy value;

determining, based on the first audio data and the lag estimate data, a second energy value associated with a second direction;

determining a second energy series associated with the second direction, the second energy series including a sequence of energy values over time ending with the second energy value;

determining that an audio source corresponds to the first direction;

performing a first cross-correlation between a target energy series and the first energy series to determine a first portion of cross-correlation data, the cross-correlation data corresponding to a correlation between each direction and the first direction that is associated with the audio source;

performing a second cross-correlation between the target energy series and the second energy series to determine a second portion of the cross-correlation data;

determining, based on the cross-correlation data, a lower boundary value and an upper boundary value; and generating, based on the lower boundary value and the upper boundary value, mask data corresponding to the audio source.

2. The computer-implemented method of claim 1, further comprising:

determining a third lag estimate value corresponding to a time delay between receipt, by the first microphone, of third audio corresponding to a third portion of the first audio data, and receipt, by the second microphone, of fourth audio corresponding to a fourth portion of the second audio data, the third lag estimate value associated with the first frequency range;

determining second lag estimate data including the third lag estimate value and a fourth lag estimate value corresponding to the second frequency range;

determining, based on the second lag estimate data, a third energy value associated with the first direction;

determining a third energy series associated with the first direction, the third energy series including a sequence of energy values over time ending with the third energy value;

determining, based on the second lag estimate data, a fourth energy value associated with the second direction;

determining a fourth energy series associated with the second direction, the fourth energy series including a sequence of energy values over time ending with the fourth energy value;

determining that the audio source corresponds to the second direction;

performing a third cross-correlation between the target energy series and the third energy series to determine a first portion of second cross-correlation data, the second cross-correlation data corresponding to a correlation between each direction and the second direction that is associated with the audio source;

performing a fourth cross-correlation between the target energy series and the fourth energy series to determine a second portion of the second cross-correlation data; and generating second mask data based on the second cross-correlation data.

3. A computer-implemented method, the method comprising:

receiving first audio data associated with a first microphone;

receiving second audio data associated with a second microphone;

determining a first lag estimate value corresponding to a time delay between receipt, by the first microphone, of first audio corresponding to a first portion of the first audio data, and receipt, by the second microphone, of second audio corresponding to a second portion of the second audio data, the first portion of the first audio data and the second portion of the second audio data associated with a first frequency range;

determining lag estimate data including the first lag estimate value and a second lag estimate value corresponding to a second frequency range;

determining, based on the first audio data and the lag estimate data, a first energy value associated with a first direction;

determining, based on the first audio data and the lag estimate data, a second energy value associated with a second direction;

determining that an audio source corresponds to the first direction;

determining cross-correlation data, a first portion of the cross-correlation data corresponding to a correlation between a first energy series associated with the first direction and a second energy series associated with the second direction, wherein the first energy series includes the first energy value and the second energy series includes the second energy value;

determining, based on the cross-correlation data, a lower boundary value and an upper boundary value; and generating, based on the lower boundary value and the upper boundary value, mask data corresponding to the audio source.

4. The computer-implemented method of claim 3, wherein the mask data indicates a plurality of frequency ranges that are associated with the audio source, the method further comprising:

generating third audio data by averaging the first audio data and the second audio data; and generating output audio data by applying the mask data to the third audio data, the output audio data including a representation of first speech generated by the audio source.

5. The computer-implemented method of claim 3, further comprising:

determining a third lag estimate value corresponding to a time delay between receipt, by the first microphone, of third audio corresponding to a third portion of the first audio data, and receipt, by the second microphone, of fourth audio corresponding to a fourth portion of the second audio data, the third lag estimate value associated with the first frequency range;

determining second lag estimate data including the third lag estimate value and a fourth lag estimate value corresponding to the second frequency range;

determining, based on the second lag estimate data, a third energy value associated with the first direction;

determining a third energy series associated with the first direction, the third energy series including a sequence of energy values over time ending with the third energy value;

determining, based on the second lag estimate data, a fourth energy value associated with the second direction;

determining a fourth energy series associated with the second direction, the fourth energy series including a sequence of energy values over time ending with the fourth energy value;

determining that the audio source corresponds to the second direction;

performing a first cross-correlation between the fourth energy series and the third energy series to determine a first portion of second cross-correlation data, the second cross-correlation data corresponding to a correlation between each direction and the second direction that is associated with the audio source;

performing a second cross-correlation between the fourth energy series and the fourth energy series to determine a second portion of the second cross-correlation data; and generating second mask data based on the second cross-correlation data.

6. The computer-implemented method of claim 3, further comprising:

determining a first energy squared value by squaring the first energy value, the first energy squared value associated with the first direction;

determining a second energy squared value by squaring the second energy value, the second energy squared value associated with the second direction;

determining energy vector data including the first energy squared value and the second energy squared value;

detecting a first plurality of peaks represented by the energy vector data, each of the first plurality of peaks corresponding to a local maximum in the energy vector data; and determining a second plurality of peaks represented by the energy vector data that satisfy a condition.

7. The computer-implemented method of claim 3, further comprising:

determining, based on the first energy value and the second energy value, energy vector data;

detecting one or more peaks within the energy vector data; and determining that at least one of the one or more peaks is between the lower boundary value and the upper boundary value.

8. The computer-implemented method of claim 3, further comprising:

determining a third lag estimate value corresponding to a third frequency range;

determining that the third lag estimate value corresponds to the first direction; and associating the third frequency range with the first direction.

9. The computer-implemented method of claim 3, wherein generating the mask data further comprises:

determining that a third direction is located between the lower boundary value and the upper boundary value;

determining that the first frequency range is associated with the third direction; and setting a first value in the mask data, the first value corresponding to the first frequency range.

10. The computer-implemented method of claim 3, further comprising:

determining, based on the first audio data and the lag estimate data, a third energy value associated with a third direction;

determining a third energy series associated with the third direction, the third energy series including a sequence of energy values over time ending with the third energy value;

determining that a second audio source corresponds to the third direction;

performing a first cross-correlation between the third energy series and the first energy series to determine a first portion of second cross-correlation data, the second cross-correlation data corresponding to a correlation between each direction and the third direction that is associated with the second audio source;

performing a second cross-correlation between the third energy series and the second energy series to determine a second portion of the second cross-correlation data;

determining, based on the second cross-correlation data, a second lower boundary value;

determining, based on the second cross-correlation data, a second upper boundary value; and generating, based on the second lower boundary value and the second upper boundary value, second mask data corresponding to the second audio source.

11. The computer-implemented method of claim 3, further comprising:

determining the first energy series, the first energy series associated with the first direction and including a sequence of energy values over time ending with the first energy value; and determining the second energy series, the second energy series associated with the second direction and including a sequence of energy values over time ending with the second energy value, wherein:

the cross-correlation data indicates a correlation between each direction and the first direction that is associated with the audio source, and determining the cross-correlation data further comprises:

determining the first portion of the cross-correlation data by performing a first cross-correlation between the second energy series and the first energy series; and determining a second portion of the cross-correlation data by performing a second cross-correlation between the first energy series and the first energy series.

12. A system comprising:

at least one processor; and memory including instructions operable to be executed by the at least one processor to cause the system to:

receive first audio data associated with a first microphone;

receive second audio data associated with a second microphone;

determine a first lag estimate value corresponding to a time delay between receipt, by the first microphone, of first audio corresponding to a first portion of the first audio data, and receipt, by the second microphone, of second audio corresponding to a second portion of the second audio data, the first portion of the first audio data and the second portion of the second audio data associated with a first frequency range;

determine lag estimate data including the first lag estimate value and a second lag estimate value corresponding to a second frequency range;

determine, based on the first audio data and the lag estimate data, a first energy value associated with a first direction;

determine, based on the first audio data and the lag estimate data, a second energy value associated with a second direction;

determine that an audio source corresponds to the first direction;

determining cross-correlation data, a first portion of the cross-correlation data corresponding to a correlation between a first energy series associated with the first direction and a second energy series associated with the second direction, wherein the first energy series includes the first energy value and the second energy series includes the second energy value;

determine, based on the cross-correlation data, a lower boundary value and an upper boundary value; and generate, based on the lower boundary value and the upper boundary value, mask data corresponding to the audio source.

13. The system of claim 12, wherein the mask data indicates a plurality of frequency ranges that are associated with the audio source and the memory further comprises instructions that, when executed by the at least one processor, further cause the system to:

generate third audio data by averaging the first audio data and the second audio data; and generate output audio data by applying the mask data to the third audio data, the output audio data including a representation of first speech generated by the audio source.

14. The system of claim 12, wherein the memory further comprises instructions that, when executed by the at least one processor, further cause the system to:

determine a third lag estimate value corresponding to a time delay between receipt, by the first microphone, of third audio corresponding to a third portion of the first audio data, and receipt, by the second microphone, of fourth audio corresponding to a fourth portion of the second audio data, the third lag estimate value associated with the first frequency range;

determine second lag estimate data including the third lag estimate value and a fourth lag estimate value corresponding to the second frequency range;

determine, based on the second lag estimate data, a third energy value associated with the first direction;

determine a third energy series associated with the first direction, the third energy series including a sequence of energy values over time ending with the third energy value;

determine, based on the second lag estimate data, a fourth energy value associated with the second direction;

determine a fourth energy series associated with the second direction, the fourth energy series including a sequence of energy values over time ending with the fourth energy value;

determine that the audio source corresponds to the second direction;

perform a first cross-correlation between the fourth energy series and the third energy series to determine a first portion of second cross-correlation data, the second cross-correlation data corresponding to a correlation between each direction and the second direction that is associated with the audio source;

perform a second cross-correlation between the fourth energy series and the fourth energy series to determine a second portion of the second cross-correlation data; and generate second mask data based on the second cross-correlation data.

15. The system of claim 12, wherein the memory further comprises instructions that, when executed by the at least one processor, further cause the system to:

determine a first energy squared value by squaring the first energy value, the first energy squared value associated with the first direction;

determine a second energy squared value by squaring the second energy value, the second energy squared value associated with the second direction;

determine energy vector data including the first energy squared value and the second energy squared value;

detect a first plurality of peaks represented by the energy vector data, each of the first plurality of peaks corresponding to a local maximum in the energy vector data; and determine a second plurality of peaks within the energy vector data that satisfy a condition.

16. The system of claim 12, wherein the memory further comprises instructions that, when executed by the at least one processor, further cause the system to:

determine, based on the first energy value and the second energy value, energy vector data;

detect one or more peaks within the energy vector data; and determine that at least one of the one or more peaks is between the lower boundary value and the upper boundary value.

17. The system of claim 12, wherein the memory further comprises instructions that, when executed by the at least one processor, further cause the system to:

determine a third lag estimate value corresponding to a third frequency range;

determine that the third lag estimate value corresponds to the first direction; and associating the third frequency range with the first direction.

18. The system of claim 12, wherein the memory further comprises instructions that, when executed by the at least one processor, further cause the system to:

determine that a third direction is located between the lower boundary value and the upper boundary value;

determine that the first frequency range is associated with the third direction; and set a first value in the mask data, the first value corresponding to the first frequency range.

19. The system of claim 12, wherein the memory further comprises instructions that, when executed by the at least one processor, further cause the system to:

determine, based on the first audio data and the lag estimate data, a third energy value associated with a third direction;

determine a third energy series associated with the third direction, the third energy series including a sequence of energy values over time ending with the third energy value;

determine that a second audio source corresponds to the third direction;

perform a first cross-correlation between the third energy series and the first energy series to determine a first portion of second cross-correlation data, the second cross-correlation data corresponding to a correlation between each direction and the third direction that is associated with the second audio source;

perform a second cross-correlation between the third energy series and the second energy series to determine a second portion of the second cross-correlation data;

determine, based on the second cross-correlation data, a second lower boundary value;

determine, based on the second cross-correlation data, a second upper boundary value; and generate, based on the second lower boundary value and the second upper boundary value, second mask data corresponding to the second audio source.

20. The system of claim 12, wherein the memory further comprises instructions that, when executed by the at least one processor, further cause the system to:

determine the first energy series, the first energy series associated with the first direction and including a sequence of energy values over time ending with the first energy value;

determine the second energy series, the second energy series associated with the second direction and including a sequence of energy values over time ending with the second energy value;

determine the first portion of the cross-correlation data by performing a first cross-correlation between the second energy series and the first energy series, the cross-correlation data corresponding to a correlation between each direction and the first direction that is associated with the audio source; and determine a second portion of the cross-correlation data by performing a second cross-correlation between the first energy series and the first energy series.

* * * * *